US010443885B2

(12) United States Patent
Son et al.

(10) Patent No.: US 10,443,885 B2
(45) Date of Patent: Oct. 15, 2019

(54) AIR HANDLER HAVING FAN MODULE AND SEPARATION PARTITION

(71) Applicant: LG ELECTRONICS INC., Seoul (KR)

(72) Inventors: Sangyuk Son, Seoul (KR); Junhee Lim, Seoul (KR); Kyungjung Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 1107 days.

(21) Appl. No.: 14/521,115

(22) Filed: Oct. 22, 2014

(65) Prior Publication Data

US 2015/0111484 A1 Apr. 23, 2015

(30) Foreign Application Priority Data

Oct. 23, 2013 (KR) ..... 10-2013-0126283
Apr. 21, 2014 (KR) ..... 10-2014-0047642

(51) Int. Cl.

| | |
|---|---|
| ***F24F 13/04*** | (2006.01) |
| ***F24F 13/02*** | (2006.01) |
| ***F24F 7/06*** | (2006.01) |
| ***F24F 13/20*** | (2006.01) |
| ***F24F 3/044*** | (2006.01) |
| *E04B 1/61* | (2006.01) |
| *E04B 1/58* | (2006.01) |

(52) U.S. Cl.

CPC ..... *F24F 13/20* (2013.01); *F24F 3/044* (2013.01); *E04B 1/6158* (2013.01); *E04B 2001/5856* (2013.01); *F24F 2221/36* (2013.01); *Y10T 29/49826* (2015.01)

(58) Field of Classification Search

CPC ..... F24F 13/20; F24F 2221/36
USPC ..... 454/261
See application file for complete search history.

(56) References Cited

U.S. PATENT DOCUMENTS

| | | | |
|---|---|---|---|
| 3,946,528 | A | 3/1976 | Jacobson |
| 4,072,187 | A | 2/1978 | Lodge |
| 4,782,637 | A | 11/1988 | Eriksson |

(Continued)

FOREIGN PATENT DOCUMENTS

| | | |
|---|---|---|
| CN | 20-1168024 | 12/2008 |
| CN | 10-1821555 | 9/2010 |

(Continued)

OTHER PUBLICATIONS

Killer, DE19710526A1 English machine translation, Sep. 17, 1998.*

(Continued)

*Primary Examiner* — Kenneth Rinehart
*Assistant Examiner* — Phillip Decker
(74) *Attorney, Agent, or Firm* — Ked & Associates, LLP

(57) ABSTRACT

An air handler having a fan module and a separation partition is provided, in which a case panel may be assembled with a plurality of module frames via a considerably simplified sliding coupling providing excellent hermetic sealing. As such, manufacturing costs may be reduced due to reduction in a number of components, and assembly time may be remarkably reduced due to a reduced number of assembly operations. This advantageously results in reduced labor cost and enhanced air conditioning efficiency.

19 Claims, 27 Drawing Sheets

(56) References Cited

U.S. PATENT DOCUMENTS

| | | | | |
|---|---|---|---|---|
| 4,860,918 | A * | 8/1989 | Wuyten | E04H 1/1238 220/668 |
| 4,891,923 | A | 1/1990 | Ericsson | |
| 4,900,108 | A | 2/1990 | Tischer | |
| 5,277,036 | A | 1/1994 | Dieckmann et al. | |
| 5,516,225 | A | 5/1996 | Kvols | |
| 5,522,768 | A | 6/1996 | Brodt | |
| 5,637,124 | A * | 6/1997 | Diachuk | B01D 46/0005 312/198 |
| 5,664,384 | A | 9/1997 | Cullinan | |
| 5,848,500 | A | 12/1998 | Kirk | |
| 6,076,739 | A | 6/2000 | Littleford | |
| 6,205,738 | B1 | 3/2001 | Chen | |
| 6,221,120 | B1 | 4/2001 | Bennington | |
| 6,370,899 | B1 | 4/2002 | Hobbs et al. | |
| 6,374,571 | B1 | 4/2002 | Mann | |
| 6,430,954 | B1 | 8/2002 | Smith | |
| 6,497,256 | B1 | 12/2002 | Adams | |
| 6,530,630 | B2 | 3/2003 | Herbeck | |
| 6,626,017 | B2 | 9/2003 | Herbeck | |
| 6,658,904 | B2 | 12/2003 | Herbeck | |
| 6,676,234 | B2 | 1/2004 | Herbeck | |
| 6,688,712 | B2 | 2/2004 | Adams et al. | |
| 6,792,722 | B2 | 9/2004 | Beser | |
| 7,000,362 | B1 | 2/2006 | Cullinan | |
| 7,332,011 | B1 | 2/2008 | Sandberg | |
| 7,334,377 | B2 | 2/2008 | Dubensky | |
| 7,338,400 | B2 | 3/2008 | Pierjob | |
| 7,678,434 | B2 | 3/2010 | Phillips | |
| 8,127,566 | B2 * | 3/2012 | Hammond | F25B 30/02 62/260 |
| 8,360,834 | B1 | 1/2013 | Semmes | |
| 8,398,365 | B2 * | 3/2013 | Hopkins | F04D 25/166 415/119 |
| 9,254,459 | B2 * | 2/2016 | Miller | F24F 3/1603 |
| 9,578,772 | B2 | 2/2017 | Podemski | |
| 9,857,093 | B2 * | 1/2018 | Son | F24F 3/044 |
| 9,857,094 | B2 * | 1/2018 | Son | F24F 3/044 |
| 9,964,330 | B2 * | 5/2018 | Son | F24F 3/044 |
| 2003/0009969 | A1 | 1/2003 | Herbeck et al. | |
| 2003/0011289 | A1 | 1/2003 | Adams et al. | |
| 2003/0111219 | A1 | 6/2003 | Edwards | |
| 2004/0063398 | A1 | 4/2004 | Beser | |
| 2005/0055917 | A1 | 3/2005 | Dubensky et al. | |
| 2005/0084324 | A1 | 4/2005 | Dubensky | |
| 2007/0052333 | A1 | 3/2007 | Freire | |
| 2007/0163295 | A1 | 7/2007 | Martin, Sr. | |
| 2007/0220851 | A1 * | 9/2007 | Parker | B01D 46/0013 55/484 |
| 2007/0257585 | A1 | 11/2007 | Kenny | |
| 2008/0083239 | A1 | 4/2008 | Meyer | |
| 2009/0019789 | A1 | 1/2009 | Gephard | |
| 2009/0031748 | A1 * | 2/2009 | Sullivan | F24F 5/0035 62/314 |
| 2009/0056248 | A1 * | 3/2009 | Pflum | F24F 3/0442 52/220.1 |
| 2010/0112930 | A1 * | 5/2010 | Grigsby | F24F 3/0442 454/333 |
| 2010/0218534 | A1 | 9/2010 | Yabu | |
| 2011/0291533 | A1 | 12/2011 | McFarland | |
| 2011/0307102 | A1 * | 12/2011 | Czamara | H05K 7/1497 700/277 |
| 2012/0242206 | A1 | 9/2012 | Gasser | |
| 2013/0118830 | A1 * | 5/2013 | Cursetjee | F24F 13/24 181/224 |
| 2015/0053374 | A1 * | 2/2015 | Kim | F24F 13/20 165/104.11 |
| 2015/0071775 | A1 * | 3/2015 | Kashihara | F24F 13/20 415/206 |

FOREIGN PATENT DOCUMENTS

| | | |
|---|---|---|
| CN | 20-1601998 | 10/2010 |
| DE | 1 604 310 | 10/1970 |
| DE | 197 10 526 | 9/1998 |
| DE | 101 55 631 | 7/2002 |
| EP | 0 387 166 B1 | 12/1993 |
| EP | 1 580 491 A1 | 9/2005 |
| EP | 2 208 945 | 7/2010 |
| GB | 2 280 951 | 2/1995 |
| JP | 2005-513359 A | 5/2005 |
| JP | 2012017603 A * | 1/2012 |
| KR | 10-2011-0056109 | 5/2011 |
| KR | 10-1122247 | 3/2012 |
| KR | 10-1294097 | 8/2013 |
| WO | WO 88/02801 | 4/1988 |
| WO | WO 2005/043048 | 5/2005 |

OTHER PUBLICATIONS

Kim, KR10-1294097B1 English machine translation, Aug. 8, 2013.*
Avallone, et al., Marks' Standard Handbook for Mechanical Engineers, p. 14-48, 1987.*
European Search Report dated Dec. 9, 2015 (2884191).
European Search Report dated Dec. 9, 2015 (2884196).
Korean Search Report dated Mar. 9, 2016 issued in Application No. 10-2014-0057395.
European Search Report dated Mar. 31, 2016.
European Search Report issued in Application No. 14189950.0 dated Apr. 5, 2016.
Korean Notice of Allowance dated Sep. 23, 2016 issued in Application No. 10-2014-0057395.
Chinese Office Action dated Nov. 22, 2016 issued in Application No. 201410573070.6.
Chinese Office Action dated Dec. 2, 2016 issued in Application No. 201410575011.2 (English Translation attached).
Chinese Office Action dated Dec. 22, 2016 issued in Application No. 201410573067.4. (English Translation attached).
United States Office Action dated Apr. 20, 2017 issued in co-pending related U.S. Appl. No. 14/520,708.
United States Office Action dated Apr. 20, 2017 issued in co-pending related U.S. Appl. No. 14/520,737.
U.S. Office Action issued in U.S. Appl. No. 14/521,706 dated Jul. 13, 2017.
United States Notice of Allowance dated Sep. 18, 2017 issued in U.S. Appl. No. 14/520,708.
United States Notice of Allowance dated Sep. 18, 2017 issued in U.S. Appl. No. 14/520,737.

* cited by examiner

AIR HANDLER HAVING FAN MODULE AND SEPARATION PARTITION

CROSS-REFERENCE TO RELATED APPLICATION(S)

This application claims priority to Korean Patent Application No. 10-2013-0126283, filed in Korea on Oct. 23, 2013, and Korean Patent Application No. 10-2014-0047642, filed in Korea on Apr. 21, 2014, the disclosures of which are incorporated herein by reference.

BACKGROUND

1. Field

An air handler and a method for assembling a fan module are disclosed herein.

2. Background

Generally, an air conditioner is a system that cools, heats, or ventilates an air conditioning object space, such as a room or space, by repeating a series of processes including suctioning in of indoor air from the room or space, providing heat exchange between the suctioned in indoor air and a low-temperature or high-temperature refrigerant, and discharging of the heat-exchanged air into the room or space. The air conditioner employs a refrigerant cycle comprised of a compressor, an expander, a first heat exchanger, that is, a condenser or evaporator, and a second heat exchanger, that is, an evaporator or condenser.

Such an air conditioner may be divided into an outdoor unit or device, which is mainly installed outside (also referred to as "outdoor side" or "heat radiation side") and an indoor unit or device, which is mainly installed inside a building (also referred to as "indoor side" or "heat absorption side"). Usually, a condenser, that is, an outdoor heat exchanger, and a compressor are installed in the outdoor unit, and an evaporator, that is, an indoor heat exchanger, is installed in the indoor unit.

As is known in the art, air conditioners may be broadly classified into a discrete type air conditioner, in which an outdoor unit and an indoor unit are separately installed, and an integral type air conditioner, in which an outdoor unit and an indoor unit are integrated. Additionally, air conditioners may be classified, based on a magnitude of capacity, into a small capacity air conditioner and a large capacity air conditioner.

In particular, a large capacity air conditioner may include an indoor unit and an outdoor unit integrated with each other, and may be configured to supply conditioned air into a plurality of object spaces requiring air conditioning through ducts, for example. An "air handling unit" or "air handler" is one type of large capacity air conditioner, which mixes outdoor air (outside air) and indoor air at an appropriate ratio to suit a target load depending on temperature, humidity, and cleanliness conditions of an object space, thereby providing a user with optimal air conditioning.

The above-described air handling unit may consist of modules having differentiated functions to ensure efficient driving of a system based on a target load of an object space.

As representative examples, air handling units are described in Korean Registered Patent No. 10-1294097 and Korean Patent Laid-open Publication No. 10-2011-0056109. In these related art air handling units, an external appearance of the air handling unit is defined by a plurality of frames forming an overall framework of the air handling unit, and a plurality of panels coupled to the plurality of frames. The plurality of frames and the plurality of panels define flow passages for the flow of conditioned air.

However, the related art air handling units suffer from an excessive number of assembly operations, because the plurality of panels must be coupled to the frames using a lot of screws to achieve a high coupling strength required to prevent leakage of conditioning air. Further, in the related art air handling units, to prevent conditioning air from leaking through gaps between the frames and the panels, it is necessary to primarily wrap electrical insulating tape around outer rim portions of the respective panels. Then, after coupling the plurality of panels to the plurality of frames via the above-described complicated process, it is necessary to secondarily apply a sealant, such as silicon, to regions where air leakage may occur based on a coupling strength between the plurality of frames and the plurality of panels.

In addition, the related art air handling units have difficulty in management and transportation of component elements because all of the component elements of the unit must be transported to an installation site and completely assembled on site, and this consequently causes increased logistics and transportation costs. The complicated installation process and transportation as described above problematically result in a delay of installation time and increased installation costs.

BRIEF DESCRIPTION OF THE DRAWINGS

Embodiments will be described in detail with reference to the following drawings in which like reference numerals refer to like elements, and wherein.

DETAILED DESCRIPTION

Advantages and features and a method of achieving the same will be more clearly understood from embodiments described below in detail with reference to the accompanying drawings. However, embodiments are not limited to the following embodiments and may be implemented in various different forms. The embodiments are provided merely to complete disclosure and to provide those skilled in the art with the category of the embodiments. Wherever possible, the same or similar reference numbers have been used throughout the specification to refer to the same or similar elements, and repetitive disclosure has been omitted.

Hereinafter, an embodiment of an air handler will be described in detail with reference to the accompanying drawings.

Figure 1:
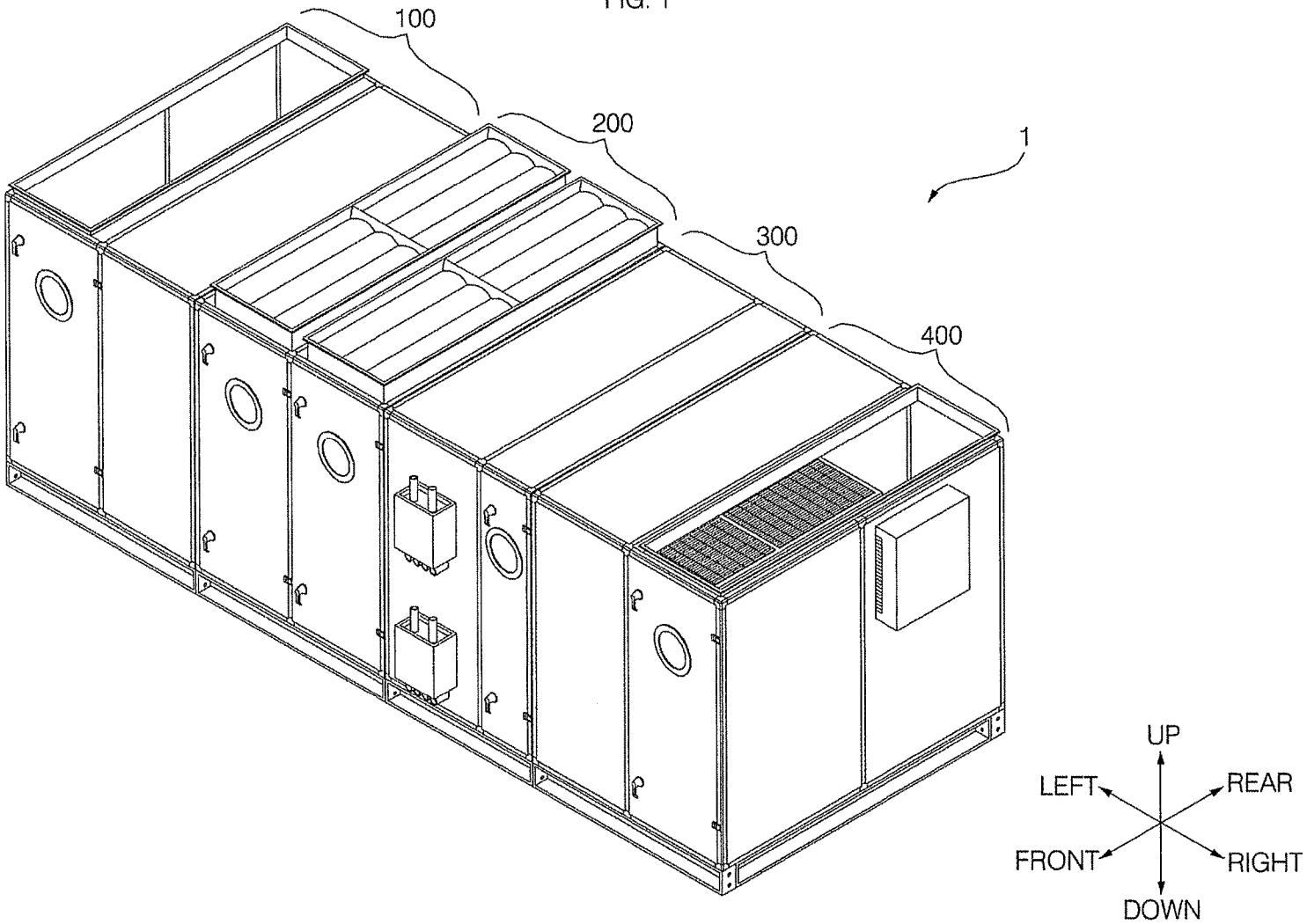
FIG. 1 is a perspective view of an air handler according to an embodiment.
Figure 2:
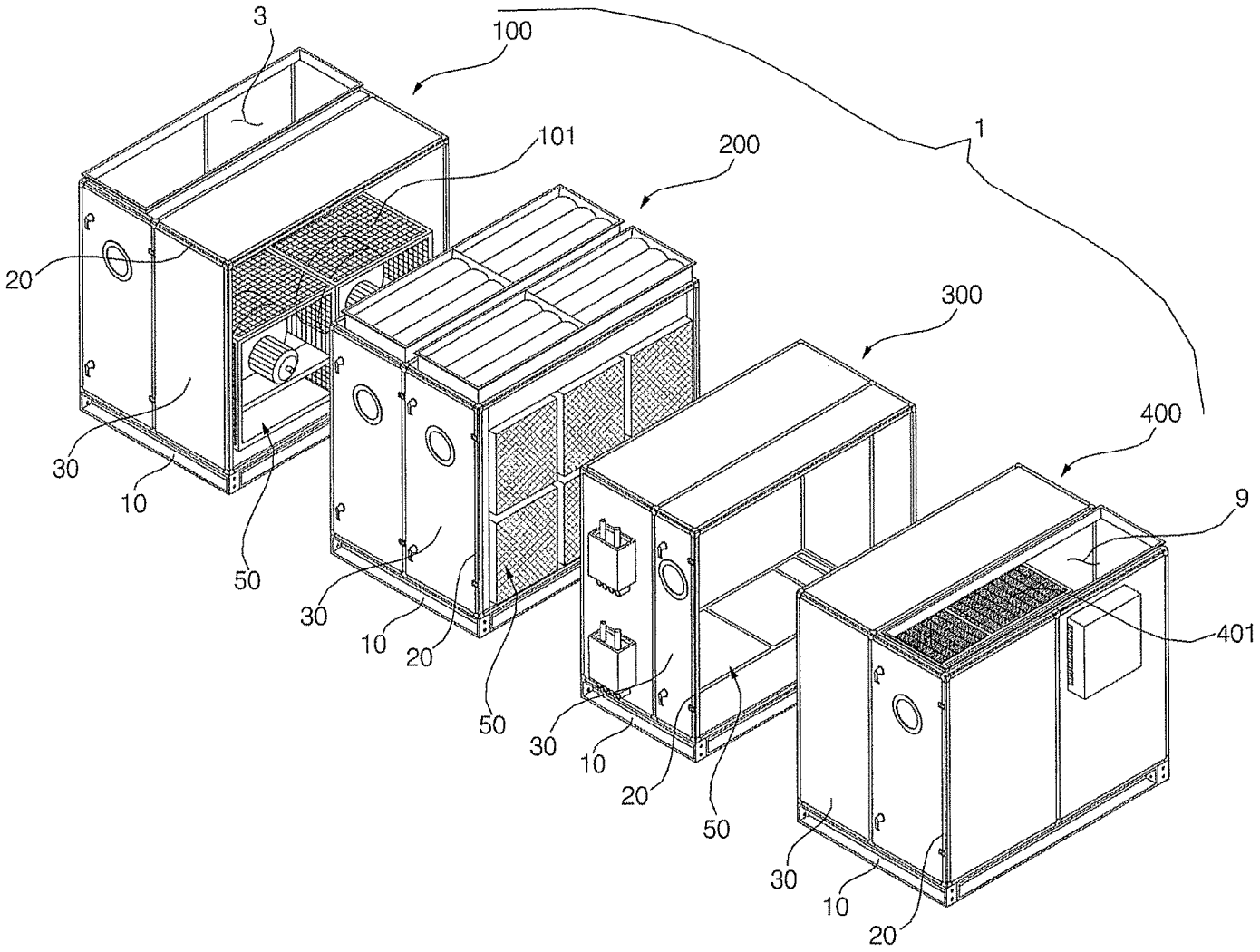
FIG. 2 is an exploded perspective view of the air handler of FIG. 1.
Figure 3:
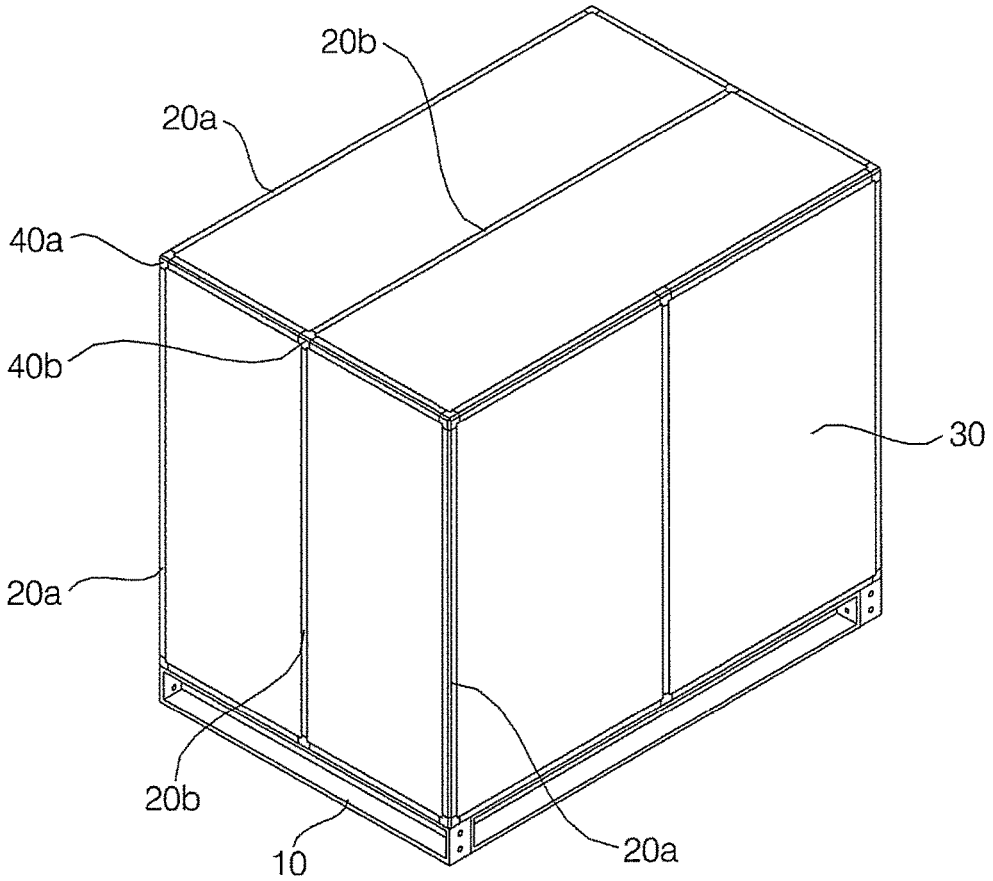
FIG. 3 is a perspective view illustrating a common assembled form of each module of the air handler of FIG. 1.
Figure 4:
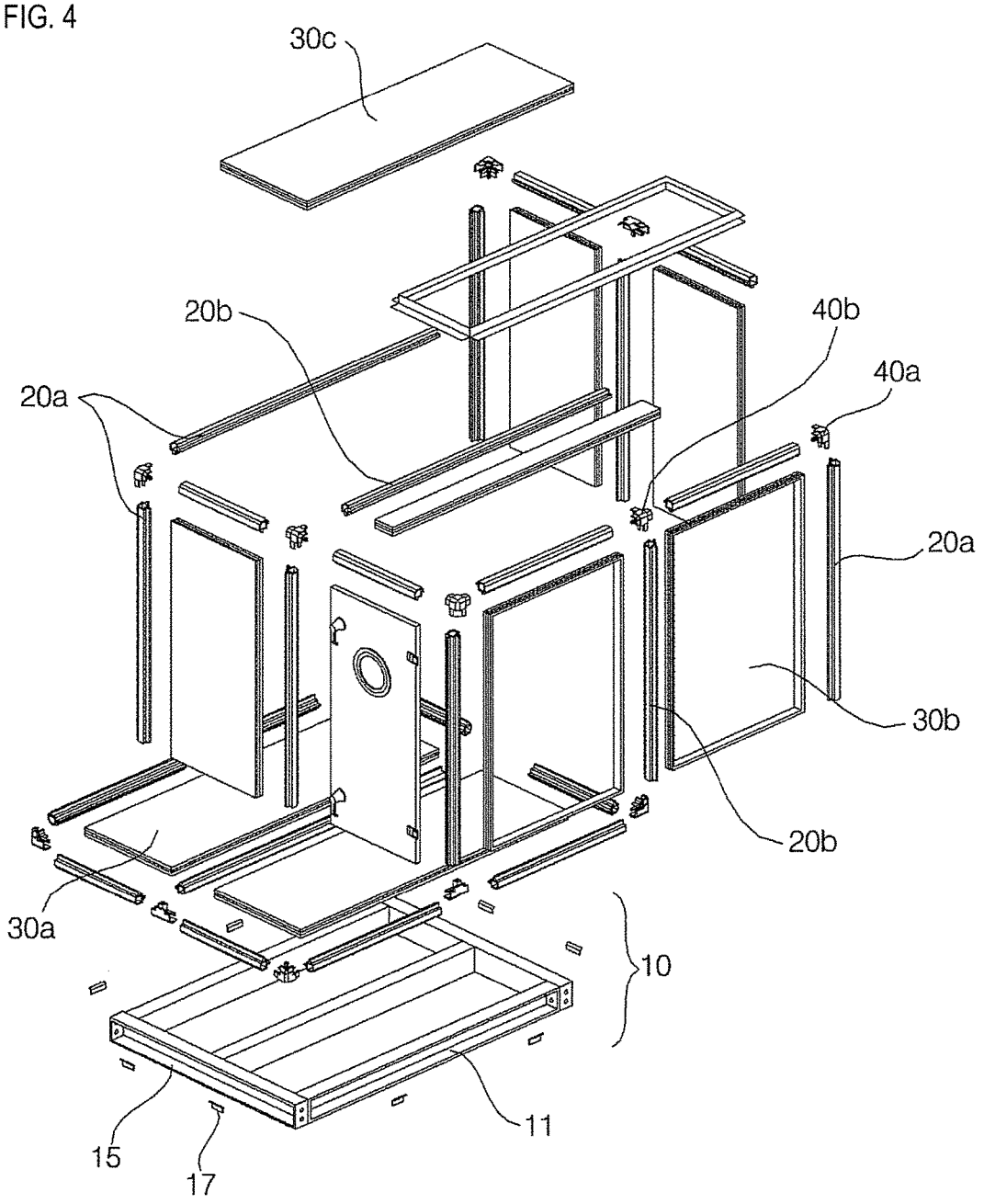
FIG. 4 is an exploded perspective view of the module of FIG. 3.
Figure 5:
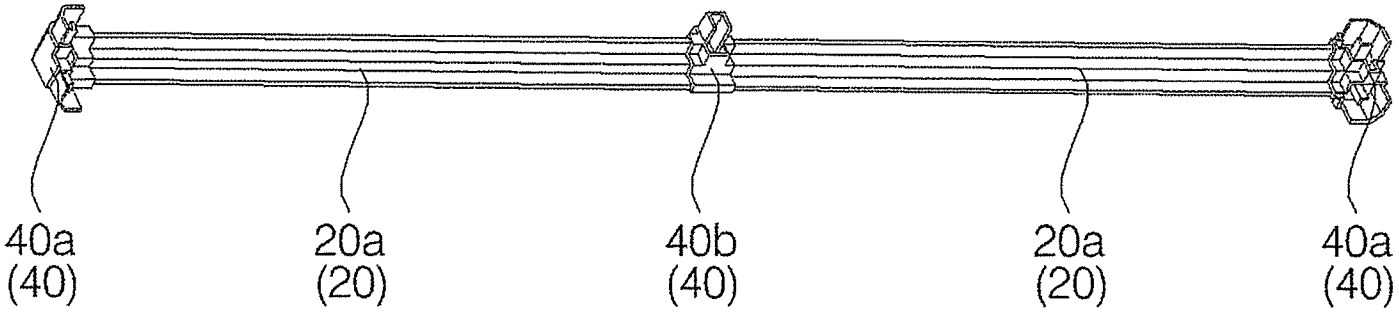
FIG. 5 is a perspective view showing a connected form of a plurality of module frames of the module of FIG. 3.
Figure 6A:
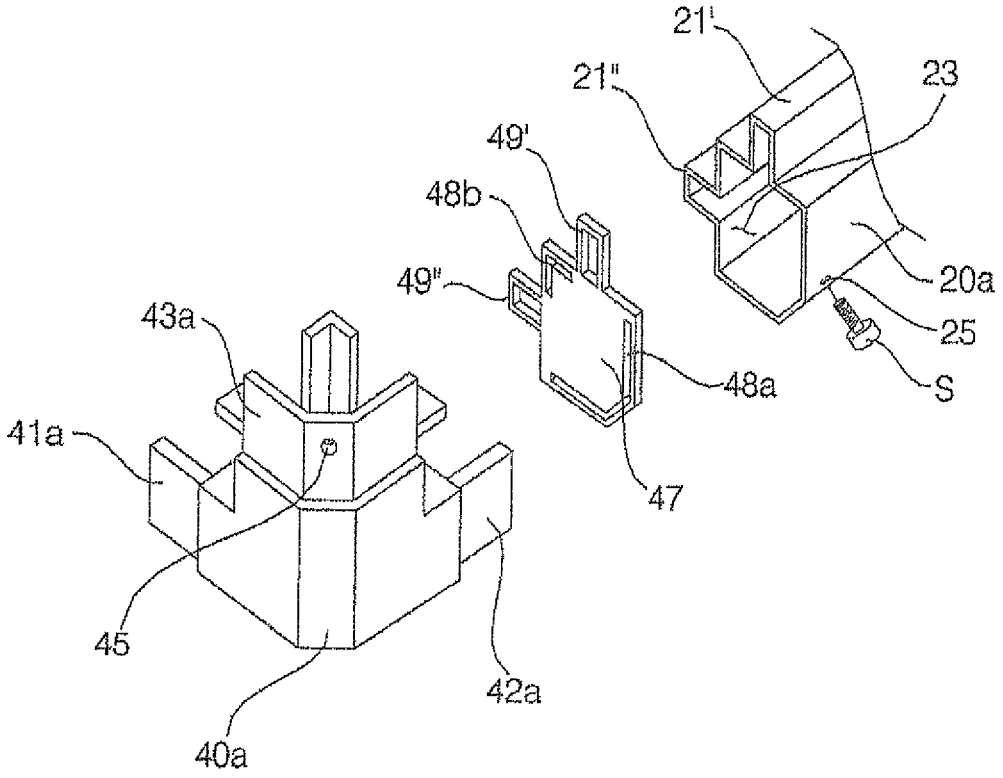
FIGS. 6A and 6B are exploded perspective views, respectively, showing a connection relationship between an edge frame and a corner connector, and a connection relationship between an edge frame and a middle connector, among the module frames of FIG. 5.
Figure 6B:
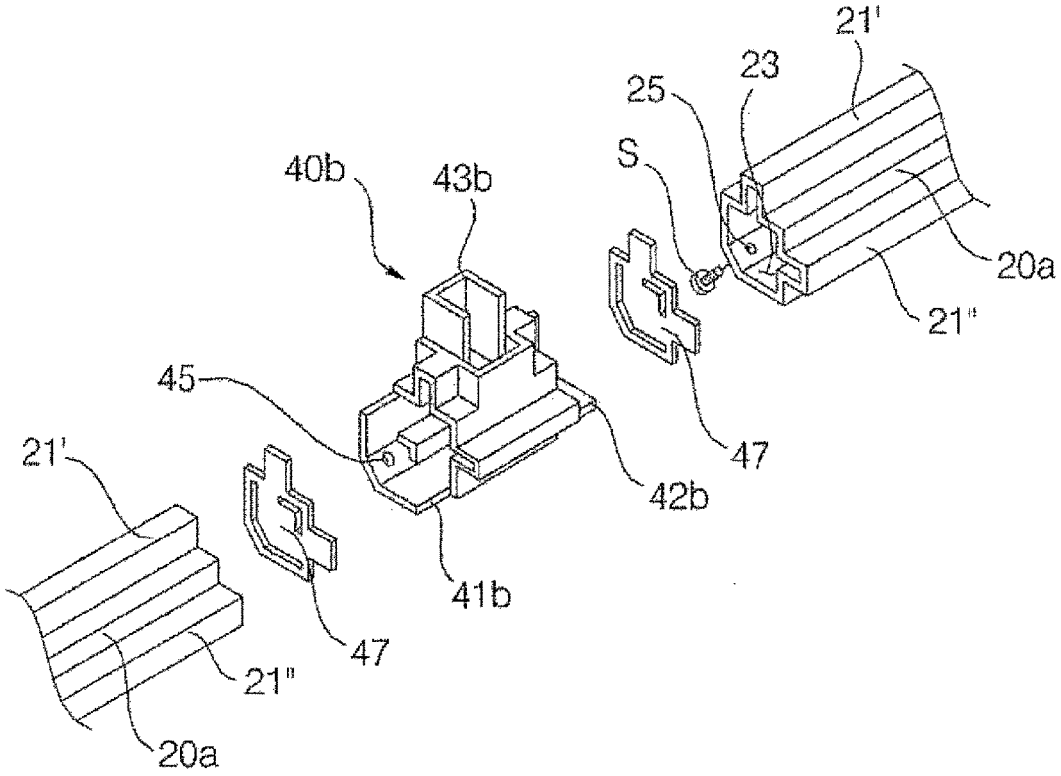
Figure 7A:
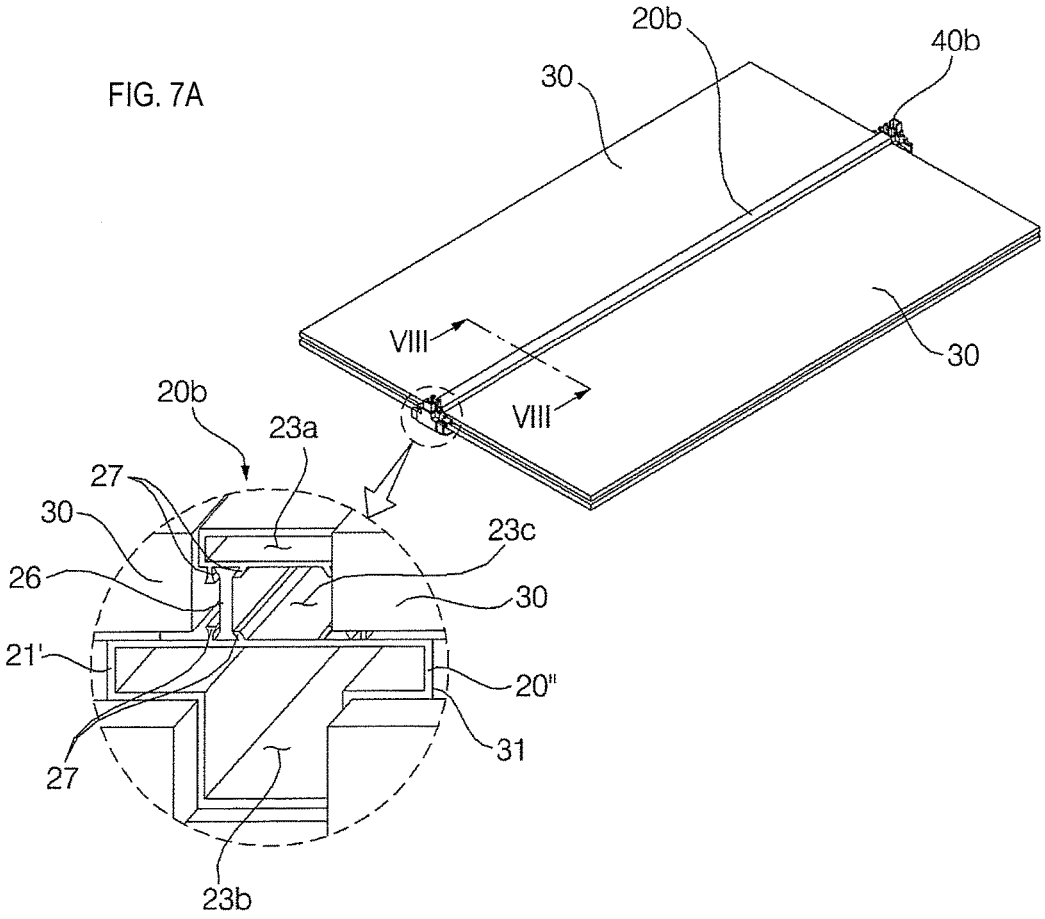
FIGS. 7A to 7C are exploded perspective views and partial enlarged perspective views showing a connected form of case panels to a middle frame, among the modules frames of FIG. 5.
Figure 7B:
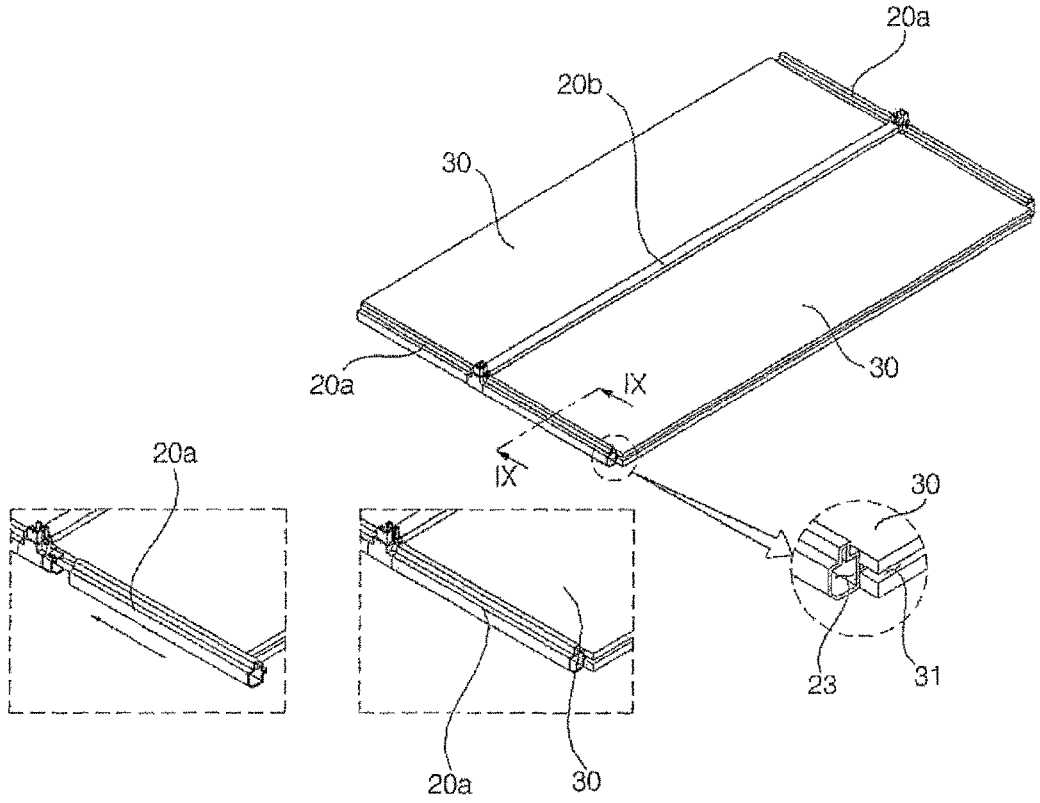
Figure 7C:
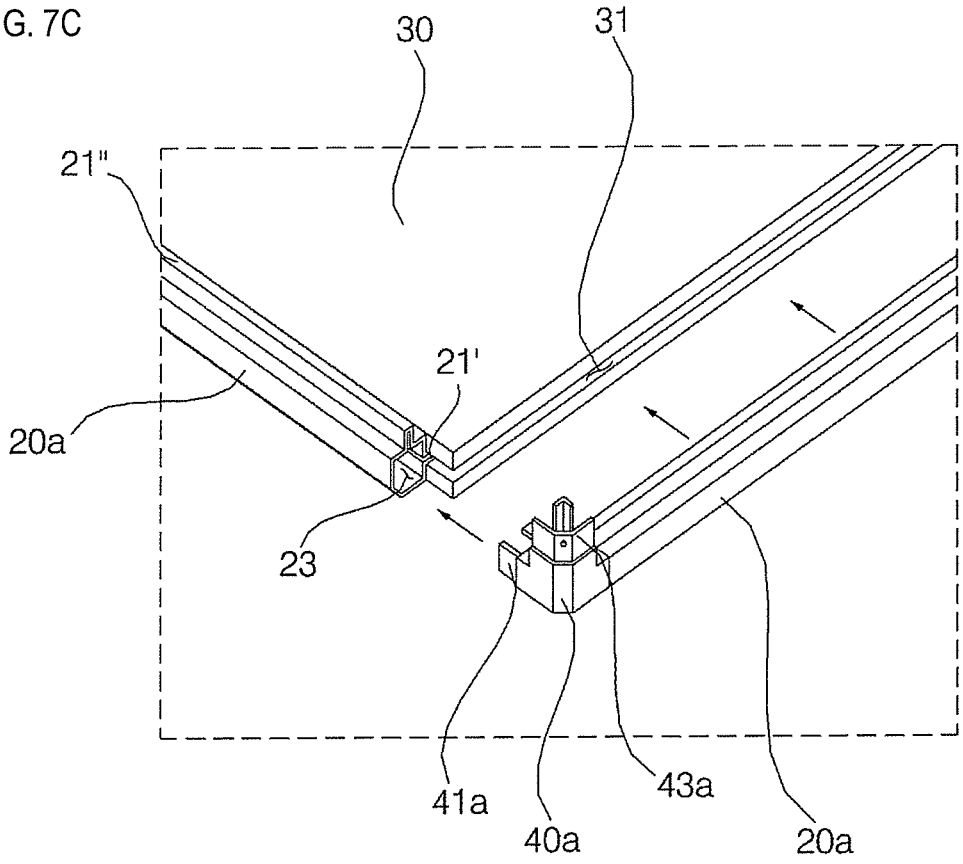
Figure 8:
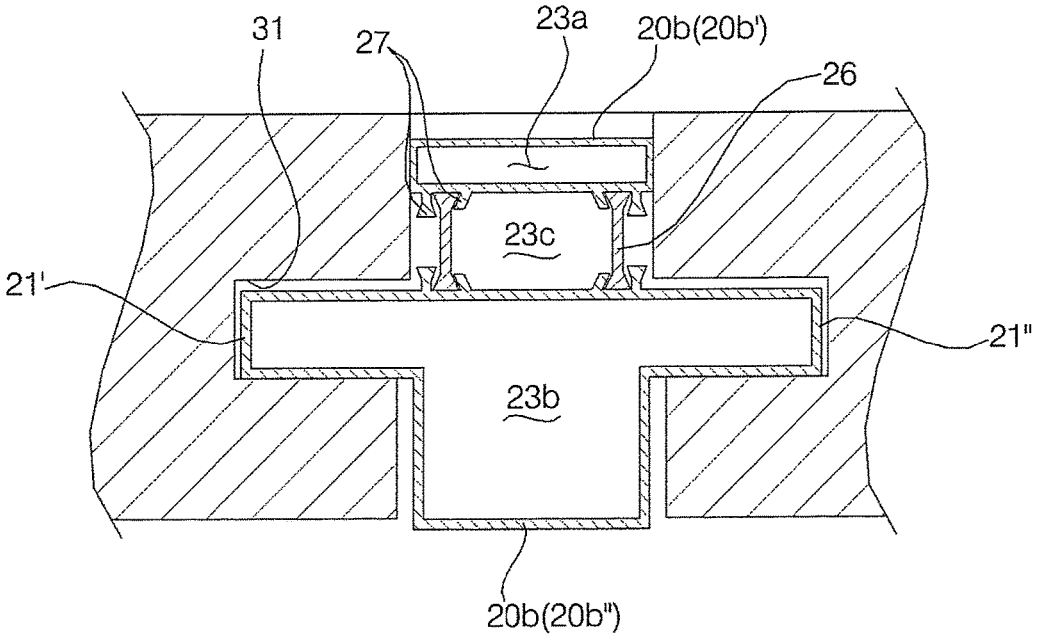
FIG. 8 is a sectional view taken along line VIII-VIII of FIG. 7A.
Figure 9A:
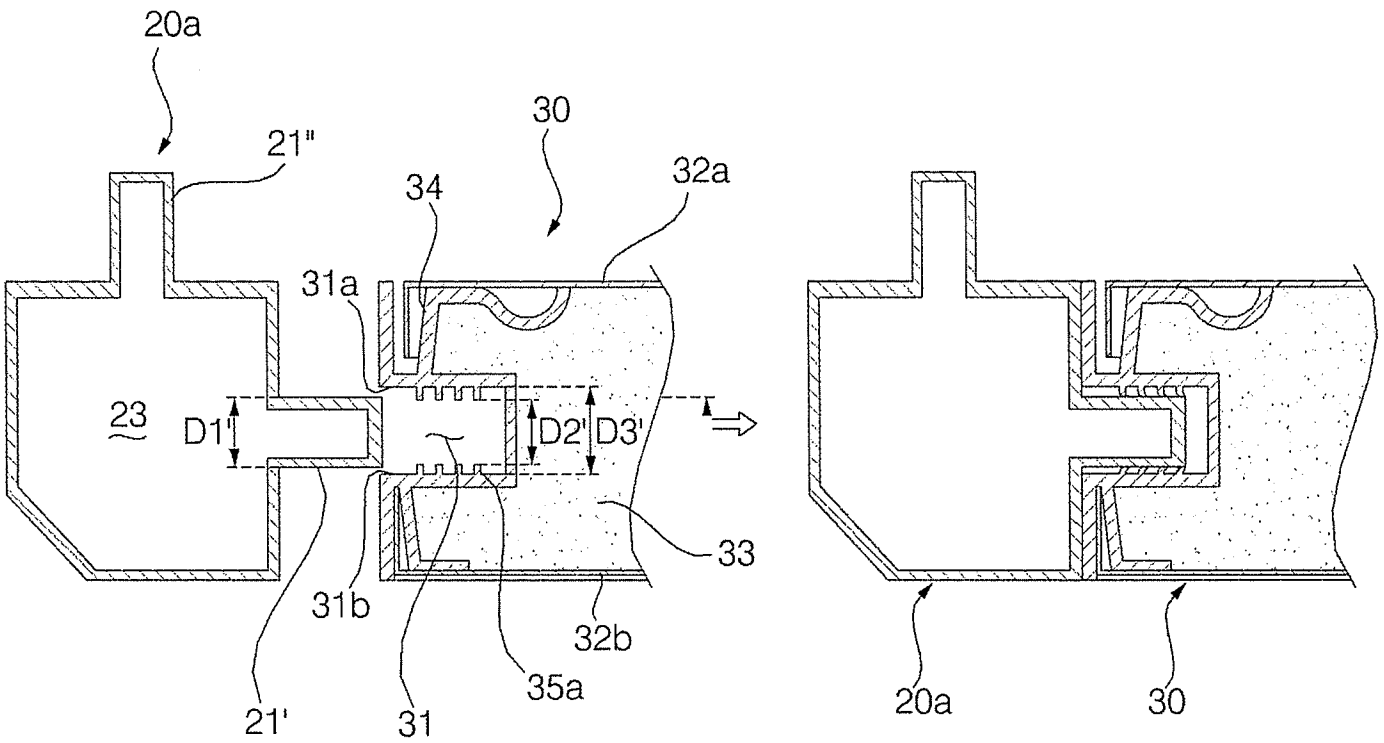
FIGS. 9A and 9B are sectional views, taken along line IX-IX of FIG. 7B, showing examples of various sealing portions between an edge frame among the module frames and a case panel.
Figure 9B:
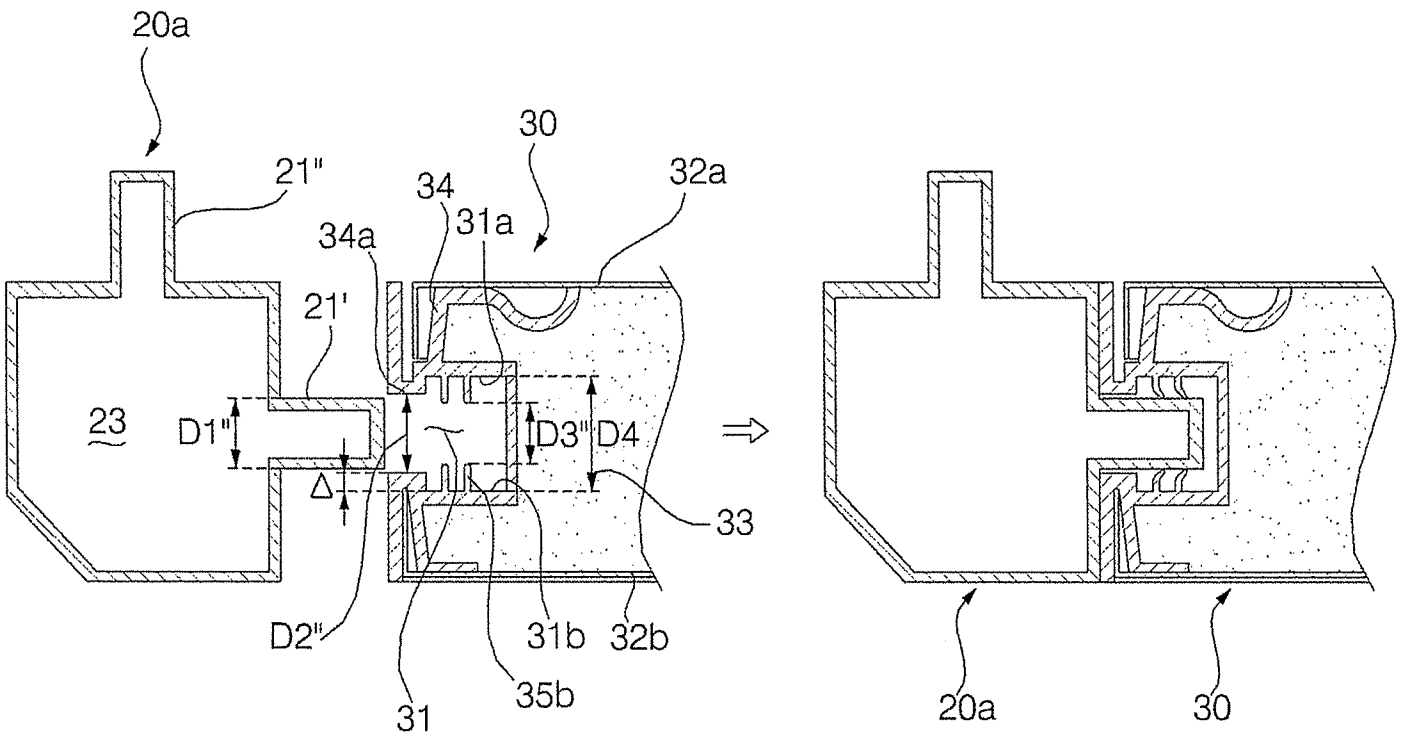

FIG. 1 is a perspective view of an air handler according to an embodiment. FIG. 2 is an exploded perspective view of the air handler of FIG. 1. FIG. 3 is a perspective view showing a common assembled form of each module of FIG. 1. FIG. 4 is an exploded perspective view of the module of FIG. 3. FIG. 5 is a perspective view showing a connected form of a plurality of module frames of the module of FIG. 3. FIGS. 6A and 6B are exploded perspective views, respectively, showing a connection relationship between an edge frame and a corner connector, and a connection relationship between an edge frame and a middle connector, among the module frames of FIG. 5. FIGS. 7A to 7C are exploded perspective views and partial enlarged perspective views showing a connected form of case panels to a middle frame, among the modules frames of FIG. 5. FIG. 8 is a sectional view taken along line VIII-VIII of FIG. 7A. FIGS. 9A and 9B are sectional views, taken along line IX-IX of FIG. 7B, showing examples of various sealing portions between an edge frame among the module frames and a case panel.

In the following description of one embodiment of the air handler, the air handler, designated by reference numeral 1, will be described using an example one type of a large capacity air conditioner, and designed to suction in and mix indoor air and outside air so as to control the mixed air to a set or predetermined condition based on an air conditioning condition (a target load), such as, for example, temperature, humidity, and cleanliness of an object space, and thereafter, to discharge the controlled air into the object space for air conditioning. However, embodiments may be implemented in equivalent implementations of large capacity air conditioners and all other air conditioners, and thus, the scope should not be construed in a narrow sense.

With reference to FIGS. 1 and 2, according to one embodiment, the air handler 1 may include an air suction module 100, a mixing module 200, a heat exchange module 300, and an air discharge module 400. The modules 100 to 400 may be divided based on differentiated functions of an air conditioning cycle. More specifically, the air suction module 100 may have a suction opening 3 to suction in indoor air and accommodate a fan module 101 to move the suctioned in indoor air. The mixing module 200 may be coupled to and in communication with the air suction module 100 and serve to mix the indoor air supplied from the air suction module 100 with outside air suctioned in from the outside. The heat exchange module 300 may be coupled to and in communication with the mixing module 200 and serve to exchange thermal energy with the mixed air supplied from the mixing module 200. The air discharge module 400 may be coupled to and in communication with the heat exchange module 300, may have a discharge opening 9, and may accommodate a fan module 401 to discharge the heat-exchanged air supplied from the heat exchange module 300 to a room through the discharge opening 9.

The air suction module 100 may function to suction in indoor air through an air suction duct (not shown) that communicates the air suction module 100 with an air conditioning object space (not shown). As such, the air suction module 100 may suction in indoor air and supply the suctioned indoor air to the mixing module 200 located at one side thereof.

The mixing module 200 may receive the indoor air supplied from the air suction module 100, and simultaneously, suction in outside air from the outside, thereby serving to adjust a mixing ratio of the indoor air and the outside air based on cleanliness, for example, of the air conditioning object space. The mixing module 200 may discharge the indoor air supplied from the air suction module 100 within a range of about 0% to 100% and receive the outside air from the outside within a range of about 0% to 100%.

The mixing module 200 may receive air from the air suction module 100 by a same amount as air discharged therefrom to the outside. For example, when discharging about 30% of air to the outside, the mixing module 200 may receive about 30% of air from the air suction module 100. In this case, the mixing module 200 may mix air supplied from the air suction module 100 and air suctioned from the outside with each other at a mixing ratio of about 7:3. The mixing ratio may be appropriately changed and adjusted in consideration of cleanliness of air or energy efficiency.

The heat exchange module 300 may perform heat exchange between the mixed air supplied from the mixing module 200 and thermal energy to heat or cool the air to suit a target load of the air conditioning object space, thereby enabling implementation of a cooling operation or heating operation. The air discharge module 400 may function to receive the heat-exchanged air from the heat exchange module 300 and discharge the air to a room which is the air conditioning object space.

In an interior of the air suction module 100, the mixing module 200, the heat exchange module 300, and the air discharge module 400 as described above, internal components 50 (101, 250, 301, 401) to perform differentiated functions of the respective modules may be installed at appropriate positions. This will be described hereinbelow in detail.

The air handler 1 according to this embodiment, as described above and as exemplarily shown in FIG. 2, may be divided into four modules 100, 200, 300 and 400 on a per function basis. These modules may be assembled respectively via a combination of a plurality of module frames 20, a plurality of case panels 30, and the internal components 50, which will be described hereinbelow, and be delivered, respectively. Through coupling of the respective assembled modules, a single air handler 1, which is normally operable, may be formed.

In particular, according to one embodiment, the modular air handler 1 may allow even a normal person rather than a skilled assembler, to simply assemble each module by reading only an installation manual and assemble the full air handler via a combination of the respective modules, and may enable assembly of the air handler with a minimum number of assembly operations by reducing the number of components, and consequently, prevent delay of overall assembly time due to the reduction in the number of components and a number of assembly operations.

With reference to FIG. 2, according to one embodiment of the air handler 1, each module may include a base 10 to support a weight of the module, a plurality of the module frames 20 installed on the base 10 to define an external appearance of the module having a predetermined shape, a plurality of the case panels 30 coupled to the plurality of module frames 20 to form surfaces of the module, and a plurality of connecting members or connectors 40 to interconnect the plurality of module frames 20. The plurality of module frames 20, as exemplarily shown in FIG. 4, form a framework of the module. More specifically, the plurality of module frames 20 may be assembled into a rectangular parallelepiped-shaped module as two or more module frames 20 are connected to one connecting member 40 to form the framework.

The plurality of modules frames 20 may include a plurality of edge frames 20*a* that forms edges of the module, and a plurality of middle frames 20*b* each having first and second ends connected to the edge frames 20*a*. The middle frames 20*b* may not be connected to angular points or corners of the module. The plurality of module frames 20 may be manufactured by aluminum extrusion or steel molding, for example, and may be formed of a thermal break material to achieve enhanced thermal barrier effects.

The plurality of edge frames 20*a*, as exemplarily shown in FIG. 4, may form respective edges of the rectangular parallelepiped module, or may respectively form a portion of each edge. In addition, as will be described hereinbelow, three edge frames 20*a* may be connected to one corner connector 40*a* to form each angular point or corner of the module.

Each of the middle frames 20*b* may be located between at least two case panels 30, including a lower cover 30*a* that forms a lower surface of the module, a side cover 30*b* that forms a side surface of the module, and an upper cover 30*c* that forms an upper surface of the module. In addition, the middle frame 20*b* may bisect the relatively long edge frame 20*a*, thereby serving to enhance rigidity of an entire module in comparison to a module assembled using only the relatively long edge frames 20*a*.

With reference to FIGS. 5 to 6B, the plurality of connecting members 40 may include corner connectors 40*a* and middle connectors 40*b*. Each of the corner connectors 40*a* may form an angular point or corner of the module as three inserting ends 41*a*, 42*a*, and 43*a* of the corner connector 40*a* arranged substantially perpendicular to one another are connected to the respective edge frames 20*a*. Each of the middle connectors 40*b* may be connected at two opposite ends thereof to the edge frames 20*a* and connected at at least one end substantially perpendicular to the two opposite ends to the middle frame 20*b* in a direction substantially perpendicular to the edge frames 20*a*.

The module frames 20, as described above, may be divided into the edge frames 20*a* and the middle frames 20*b* in every region forming the framework of the module.

With reference to FIGS. 5 to 6B, the edge frames 20*a* may be connected to one another by one or more corner connectors 40*a* and middle connectors 40*b* to form edges of the module. With reference to FIGS. 7A to 7C, the middle frames 20*b* may be, respectively, located between two case panels 30 and coupled at both ends thereof to the middle connectors 40*b*. Thereby, as described above, the middle frames 20*b* may, respectively, bisect the relatively long edge frame 20*a* or the relatively large case panel 30 to enhance rigidity of the module.

With reference to FIGS. 5 and 6A, each of the corner connectors 40*a* may have the three inserting ends 41*a*, 42*a*, and 43*a* arranged in such a way that any one inserting end 41*a* may protrude substantially perpendicular to two inserting ends 42*a* and 43*b*. The three inserting ends 41*a*, 42*a*, and 43*a* may be inserted into hollow ends 23 of the respective edge frames 20*a*, which may be coupled to the corner connector 40*a* to form edges of the module.

A first screw fastening hole 25 may be formed in the hollow end 23 of the edge frame 20*a*, and a second screw fastening hole 45 corresponding to the first screw fastening hole 25 may be formed in the inserting end 43*a* of the corner connector 40*a*. Thereby, as a screw S may be fastened through the first screw fastening hole 25 and the second screw fastening hole 45 in a state in which the inserting end 43*a* of the corner connector 40*a* is inserted into the hollow end 23 of the edge frame 20*a*, the framework of the module may be firmly assembled.

With reference to FIGS. 5 and 6B, each of the middle connectors 40*b* may have three inserting ends 41*b*, 42*b* and 43*b* arranged in such a way that any one inserting end 43*b* (hereinafter referred to as "third inserting end 43*b*") may protrude substantially perpendicular to two inserting ends 41*b* and 42*b* (hereinafter referred to as "first inserting end 41*b*" and "second inserting end 42*b*", respectively, and the first inserting end 41*b* and the second inserting end 42*b* may be linearly arranged to protrude in opposite directions. The third inserting end 43*b* may be inserted into a hollow end (not shown) of the middle frame 20*b*, and the first inserting end 41*b* and the second inserting end 42*b* may be, respectively, inserted into the hollow ends 23 of the edge frames 20*a*.

It should be understood that a screw fastening hole (not shown) corresponding to the first screw fastening hole 25 of the edge frame 20*a* may be formed in the third inserting end 43*b* of the middle connector 40*b*, a screw fastening hole (not shown) corresponding to the screw fastening hole of the middle connector 40*b* may be formed in the middle frame 20*b*, and the second screw fastening hole 45 corresponding to the first screw fastening hole 25 of the edge frame 20*a* may be formed in each of the first inserting end 41*b* and the second inserting end 42*b* of the middle connector 40*b*. The first inserting end 41*b* and the second inserting end 42*b* of the middle connector 40*b* may be, respectively, inserted into and coupled to the hollow ends 23 of the edge frames 20*a* arranged at opposite sides thereof, and the third inserting end 43*b* of the middle connector 40*b* may be inserted into and coupled to the hollow end (not shown) of the middle frame 20*b*.

Each of the module frames 20 may be provided with one or more sliding ribs 21' and 21" that protrude outward in a substantially longitudinal direction thereof. The sliding ribs 21' and 21", as will be described hereinbelow, may be fitted into sliding rail grooves 31 formed in a rim or at outer edges of the case panels 30. The sliding ribs 21' and 21" of each module frame 20 may be equal in number to a number of the case panels 30 to be connected to the module frame 20.

For example, with reference to FIG. 6A, the edge frame 20*a*, which may be disposed immediately above the base 10 among the module frames 20, may be provided with two sliding ribs 21' and 21". More specifically, the two sliding ribs 21' and 21" may include a first sliding rib 21' inserted into the sliding rail groove 31 formed in a rim of the case panel 30 that forms a lower surface of the module, that is, the lower cover 30*a*, and a second sliding rib 21' inserted into the sliding rail groove 31 formed in a lower end rim of the case panel 30 that forms a side surface of the module, that is, the side cover 30*b*.

As another example, with reference to FIGS. 7A to 7C, the middle frame 20*b*, which may extend along a middle portion of the case panel 30 that forms a lower surface of the module, that is, the lower cover 30*a*, may be provided with three sliding ribs 21' and 21". More specifically, the middle frame 20*b* may be provided with a pair of sliding ribs inserted into the sliding rail grooves 31 formed in rims of the case panels 30 arranged at horizontal opposite sides of the middle frame 20*b*. In addition, in consideration of a case in which a case panel (not shown) is coupled to an upper surface of the middle frame 20*b* in a direction substantially perpendicular to the middle frame 20*b*, the middle frame 20*b* may further be provided with a third sliding rib 21" inserted into the sliding rail groove 31 formed in the rim of the case panel (not shown) above the middle frame 20*b*. Here, although a case of the lower cover 30*a* has been described, the description may be equally applied to a case in which the middle frame 20*b* is provided at the side cover 30*b* or the upper cover 30*c*.

Meanwhile, as exemplarily shown in FIGS. 6A and 6B, sealing pads 47 may be interposed, respectively, between the inserting ends 41*a*, 42*a*, and 43*a* of the corner connector 40*a* and ends of the module frames 20. The sealing pads 47 may be configured to come into close contact with the module, frames 20 and the corner connector 40*a* upon coupling of the module frames 20 and the corner connector 40*a*, thereby serving to block gaps between the module frames 20 and the corner connector 40*a* to prevent leakage of air from the module.

With reference to FIG. 6A, each of the sealing pads 47 may have an end penetration hole 48*a* for penetration of the inserting end 41*a*, 42*a*, or 43*a* of the corner connector 40*a*. As such, the sealing pad 47 may completely seal a gap between the module frame 20 and the corner connector 40*a* except for a space for penetration of the inserting end 41*a*, 42*a*, or 43*a*. In addition, the sealing pad 47 may have a same shape as the hollow end 23 of the module frame 20 to prevent the end of the module frame 20 from coming into contact with the corner connector 40*a*. In a case in which the module frame 20 and the corner connector 40*a* are formed, respectively, of a metallic material having high thermal conductivity, the sealing pad 47 may also serve to prevent leakage of energy by reducing high metal-to-metal thermal conductivity.

It will be understood that, in addition to the corner connector 40*a*, the sealing pad 47 may be interposed between the middle connector 40*b* and the middle frame 20*b*, or between the middle connector 40*b* and the edge frame 20*a*. The sealing pad 47 may be fitted to each inserting end 41*a*, 42*a*, or 43*a* (41*b*, 42*b*, or 43*b*) of the connecting member 40, thereby assisting the inserting end 41*a*, 42*a*, or 43*a* (41*b*, 42*b*, or 43*b*) of the connecting member 40 in being sealed upon insertion into the end of the module frame 20.

Assembly of the module via a combination of the module frames 20, the case panels 30, and the connecting members 40 will be described hereinbelow. For convenience of understanding, only an assembly process of forming the lower cover 30*a* of the module will be described below by way of example.

With reference to FIGS. 7A and 7B, the module frames 20 and the connecting members 40 may be assembled with one another to form a framework of a rim of the lower cover 30*a*. Although the module frames 20, more particularly, the edge frames 20*a* may be assembled with one another using only the corner connectors 40*a* to form a simple rectangular framework, in some cases, the middle frames 20*b* and the middle connectors 40*b* may be additionally used to bisect the rectangular framework. In particular, in one embodiment, rigidity of an entire module may be enhanced as the middle frame 20*b* may be used to divide the relatively long edge frame 20*a* into two members.

Among the module frames 20 forming the framework of the rim of the lower cover 30*a* as described above, any one edge frame 20*a* may be omitted to open one side of the framework. This may serve to allow sliding coupling between the sliding ribs 21' and 21" of the module frames 20 and the sliding rail grooves 31 formed in the rim of the lower cover 30*a*. Thereby, as the lower cover 30*a* may horizontally slide through the open side of the framework, the sliding ribs 21' and 21" may be inserted into the sliding rail grooves 31. That is, as the sliding rail grooves 31 formed in one end or both ends of the case panel 30 may be fitted on the sliding ribs 21' and 21" of the module frames 20 forming the framework having at least one open side, the case panel 30 may be coupled to the module frames 20 via sliding thereof toward a closed opposite side of the framework.

However, it will be understood that sliding coupling of the case panel 30 to the module frames 20 may not be absolutely necessary, and conversely, sliding coupling may be performed in such a way that the sliding ribs 21' and 21" of the module frames 20 may be fitted into the sliding rail grooves 31 of the case panel 30.

The air handler 1 according to one embodiment may be assembled by combining the above-described two sliding coupling methods, and provide diversity of assembly to allow an assembler to select a best method to improve assembly efficiency in consideration of an assembly environment on site or propensity of the assembler.

In the related art, upon installation of an air handling unit or air handler, which is a relatively large structure installed in a building, to firmly install frames forming the overall framework of the air handler, it was essential to fasten a lot of screws between the frames and case panels. This screw fastening involves an excessive number of assembly operations for coupling of the respective screws, and results in reduction in rigidity of the entire unit and deterioration of sealing performance when the fastened screws have work loose by variation in interior air pressure during operation of the air handler.

According to one embodiment of the air handler 1, except for screw fastening between the module frames 20 and the connecting members 40, coupling between the module frames 20 and the case panels 30 may be performed via sliding coupling without using screws, which may considerably reduce a number of assembly operations using screws and prevent deterioration of rigidity in screw fastening regions.

Meanwhile, in the air handler according to embodiments, it is very important to prevent leakage of air from the air handler to the outside. This is because leakage of conditioned air reduces an interior pressure of the air handler, thus causing pressure loss and deteriorating overall air conditioning performance.

In the related art, a plurality of frames is coupled to one another to form the framework of an air handler via screw fastening or welding, and an inconvenient sealing operation to isolate an interior of the air handler from the outside must be performed after fitting case panels into openings corresponding to a shape of the case panels. More specifically, in the related art, for primary sealing, a rim of each case panel is wrapped using electrical insulating tape prior to fitting the case panel into the opening. Then, for secondary sealing, a sealant, such as silicon, is applied to a gap between the case panel and the opening.

One embodiment of the air handler 1 proposes to provide a sliding coupling structure between the module frames 20 and the case panels 30 with a sealing structure capable of preventing leakage of conditioned air from the interior of the module to the outside and preventing heat transfer from the interior of the module to the outside. With reference to FIGS. 9A and 9B, each of the case panels 30 may include an inner plate 32*a* forming an inner surface of the module, an outer plate 32*b* outwardly spaced substantially in parallel from the inner plate 32*a* by a predetermined distance to form an outer surface of the module, a joint member 34 to finish ends of the inner plate 32*a* and the outer plate 32*b* along rims thereof, and a heat insulating material 33 filled between the inner plate 32*a* and the outer plate 32*b*.

The inner plate 32*a* and the outer plate 32*b* may be formed of a metallic material in consideration of rigidity of the entire module. The heat insulating material 33 filled between the inner plate 32*a* and the outer plate 32*b* may serve to prevent conditioned air from radiating heat to the outside. The heat insulating material 33 may be polyurethane (PU) foam.

A thickness of the case panel 30 corresponding to a distance between the inner plate 32*a* and the outer plate 32*b* may be set to an appropriate value in consideration of a volume of the entire air handler 1 and heat insulation effects of the heat insulating material 33.

According to one embodiment of the air handler 1, assembly of each module may be completed in a simplified manner using only sliding coupling between the module frames 20 and the case panels 30 without requiring the complicated screw fastening and welding of the related art, and the above-described additional sealing operation may be unnecessary. Accordingly, assembly of the air handler 1 may be accomplished in a simplified manner by a few assemblers and with a reduced number of assembly operations. In particular, as will be described below, according to one embodiment of the air handler 1, an additional sealing operation beyond sliding coupling between the module frames 20 and the case panels 30 may be unnecessary.

With reference to FIG. 8, the middle frame 20*b* may have a heat transfer barrier 26 to prevent transfer of heat from the interior of the module to the outside. The heat transfer barrier 26 may have not only a heat transfer prevention function, but also a general sealing function to prevent leakage of air by coming into close contact with an outer end surface of the sliding rail groove 31 of the case panel 30. More specifically, with reference to FIG. 8, the middle frame 20*b* may include a first frame 20*b*' arranged close to an inner space of the module, the first frame 20*b*' forming a first hollow region 23*a* having a closed cross section, and a second frame 20*b*" spaced from the first frame part 20*b*' by a predetermined distance and arranged close to the outside of the module, the second frame 20*b*" forming a second hollow region 23*b* having a closed cross section. The heat transfer barrier 26 may be a connector that interconnects the first frame 20*b*' and the second frame 20*b*".

The sliding ribs 21' and 21" may be formed at the second frame 20*b*" having the second hollow region 23*b*, and the first frame 20*b*' may have a sliding rib (not shown) corresponding to the above-described sliding rib, so as to be fitted into the sliding rail groove 31 of the case panel 30, which may be provided to cross the inner space of the module as needed.

The heat transfer barrier 26 may include a pair of connectors that interconnect the first frame 20*b*' and the second frame 20*b*" to form a third hollow region 23*c* having a closed cross section between the first frame 20*b*' and the second frame 20*b*". The first frame 20*b*' and the second frame 20*b*" of the middle frame 20*b* may be formed of a metallic material including aluminum or steel in consideration of rigidity of the framework of the module. The heat transfer barrier 26 may be formed of polyamide. As is well known in the art, polyamide is an electrical insulating material and may serve to minimize a heat transfer structure by preventing the metallic case panel 30 from coming into contact with the metallic middle frame 20*b* upon sliding coupling of the case panel 30 and the middle frame 20*b*.

Generally, a thin air layer not causing convection is well known as a highly excellent heat insulating layer. The first to third hollow regions 23*a*, 23*b*, and 23*c* formed in the middle frame 20B may serve as heat insulating layers that cause minimum air convection as long as there are no special circumstances. In addition, the first to third hollow regions 23*a*, 23*b*, and 23*c* may serve not only to reduce a weight of the middle frame 20*b*, but also to provide the middle frame 20*b* with protruding portions to increase a perimeter of the entire middle frame 20*b*, which may increase transverse rigidity of the middle frame 20*b*.

In particular, the first to third hollow regions 23*a*, 23*b*, and 23*c* may be arranged in sequence from an inner side to an outer side of one middle frame 20*b*, thereby serving to extremely minimize transfer of heat from the interior of the module to the outside. The heat transfer barrier 26 may be interposed between the metallic first frame 20*b*' and the metallic second frame 20*b*", respectively, located close to the inner space of the module and the outside of the module, thereby serving to interconnect the frames 20*b*' and 20*b*" and to minimize heat transfer.

The first frame 20*b*' and the second frame 20*b*" may have retaining portions 27 by which ends of the heat transfer barrier 26 may be caught. More specifically, both ends of the heat transfer barrier 26 may be arranged to come into contact with facing surfaces of the first frame 20*b*' and the second frame 20*b*" and have a triangular cross section, one side of which may come into surface contact with the corresponding retaining portion. The retaining portions 27 may be arranged at both sides of each end of the heat transfer barrier 26 to surround the end of the heat transfer barrier 26, thereby serving to firmly grip and secure the end of the heat transfer barrier 26. Although the heat transfer barrier 26 may be coupled to the first frame 20*b*' and the second frame 20*b*"

via, for example, fitting or welding, embodiments are not limited by the aforementioned coupling method.

According to one embodiment of the air handler 1, the case panel 30, as described above, may include the inner plate 32*a* forming an inner surface of the module, the outer plate 32*b* outwardly spaced substantially in parallel from the inner plate 32*a* by a predetermined distance to form an outer surface of the module, the joint member 34 for finishing of ends of the inner plate 32*a* and the outer plate 32*b* along rims thereof, and the heat insulating material 33 filled between the inner plate 32*a* and the outer plate 32*b*. The sliding rail groove 31, into which the sliding rib 21' or 21" of each of the module frames 20 may be slidably fitted, may be formed in the joint member 34 of the case panel 30. The joint member 34 may be formed of a non-metallic material having low thermal conductivity, and may be formed of an easily moldable synthetic resin material, such as plastic. The sliding rail groove 31 may be formed throughout the rim of the case panel 30, and may have an approximately "ㄷ"-shaped cross section so as to be indented to allow insertion of the sliding rib 21' or 21" therein.

In addition, with reference to FIGS. 9A and 9B, the case panel 30 may further include sealing portions 35*a* and 35*b* to prevent leakage of air from a gap between the module frame 20, more particularly, the edge frame 20*a*, and the case panel 30 upon sliding coupling of the case panel 30 and the edge frame 20*a*. The sealing portions 35*a* and 35*b* may be formed in the sliding rail groove 31 and may be integrally formed with the joint member 34 by, for example, injection molding.

More specifically, with reference to FIG. 9A, the sliding rail groove 31, as described above, may have a "ㄷ"-shaped cross section, one end of which may be open for insertion of the sliding rib 21' or 21" of the edge frame 20*a* thereinto, and the sealing portions 35*a*, 35*b* may, respectively, protrude from a first surface 31*a* and a second surface 31*b*, adjacent to the open end of the sliding rail groove 31, toward opposite surfaces by a predetermined consistent length.

A thickness D1 of the sliding rib 21' or 21" of the edge frame 20*a* may be less than a width D3' of the sliding rail groove 31 of the case panel 30 and greater than at least a distance D2' between tip ends of the sealing portions 35*a* that protrude from the opposite surfaces of the sliding rail groove 31. In such a state, when the sliding rib 21' or 21" of the edge frame 20*a* is inserted into the sliding rail groove 31 of the case panel 30, the sliding rib 21' or 21" may be inserted into the sliding rail groove 31 so as not to come into contact with the sliding rail groove 31, and the sealing portions 35*a* may hermetically come into close contact with an outer surface of the sliding rib 21 or 21", resulting in enhanced sealing performance. That is, the sealing portions 35*a* may, respectively, protrude from the first surface 31*a* and the second surface 31*b* of the sliding rail groove 31 in opposite directions by the predetermined consistent length, and the distance D2' between the tip ends of the respective sealing portions 35*a* may be less than the thickness D1 of the sliding rib 21 or 21" inserted into the sliding rail groove 31.

Alternatively, with reference to FIG. 9B, the sliding rail groove 31 may have a "ㄷ"-shaped cross section, one end of which may be open for insertion of the sliding rib 21' or 21" of the edge frame 20*a*, a length D2" of the open end 34*a* may be less than a distance D4 between the first surface 31*a* and the second surface 31*b* of the sliding rail groove 31 (see reference letter "Δ" of FIG. 9B), the sealing portions 35*b* may, respectively, protrude from the first surface 31*a* and the second surface 31*b*, adjacent to the open end 34*a* of the sliding rail groove 31, toward the opposite surfaces by a predetermined consistent length, and a distance D3" between the protruding sealing portions 35*b* may be less than the length D2" of the open end 34*a*. That is, the sealing portions 35*b* may, respectively, protrude from the first surface 31*a* and the second surface 31*b* of the sliding rail groove 31 in opposite directions by the predetermined consistent length, and the distance D3" between the tip ends of the respective protruding sealing portions 35*b* may be less than the length D2" of the open end 34*a* of the sliding rail groove 31. The sealing portions 35*b* may protrude, respectively, from the first surface 31*a* and the second surface 31*b* of the sliding rail groove 31 by the predetermined consistent length, and the distance D3" between the tip ends of the respective protruding sealing portions 35*b* may be less than a thickness D1" of the sliding rib 21' or 21" inserted into the sliding rail groove 31.

The sealing portions 35*a* and 35*b* may be integrally formed in the sliding rail groove 31 of the joint member 34 by, for example, injection molding. A portion of the joint member 34, in which the sliding rail groove 31 may be formed, may be formed of a hard material to maintain rigidity of the module. The sealing portions 35*a* and 35*b* may be formed of a soft material, and thus, may be deformed to some extent upon insertion of the sliding rib 21' or 21" of the edge frame 20*a*, thereby coming into close contact with the sliding rib 21' or 21".

According to one embodiment of the air handler 1, as described above, upon sliding coupling of the module frame 20 and the case panel 30, heat insulation performance may be primarily enhanced by the heat insulating material 33 between the metallic inner plate 32*a* and the metallic outer plate 32*b* of the case panel 30, and hermetic sealing performance to prevent leakage of air may be secondarily enhanced by the sealing portions 35*a* and 35*b* of the case panel 30.

Figure 10:
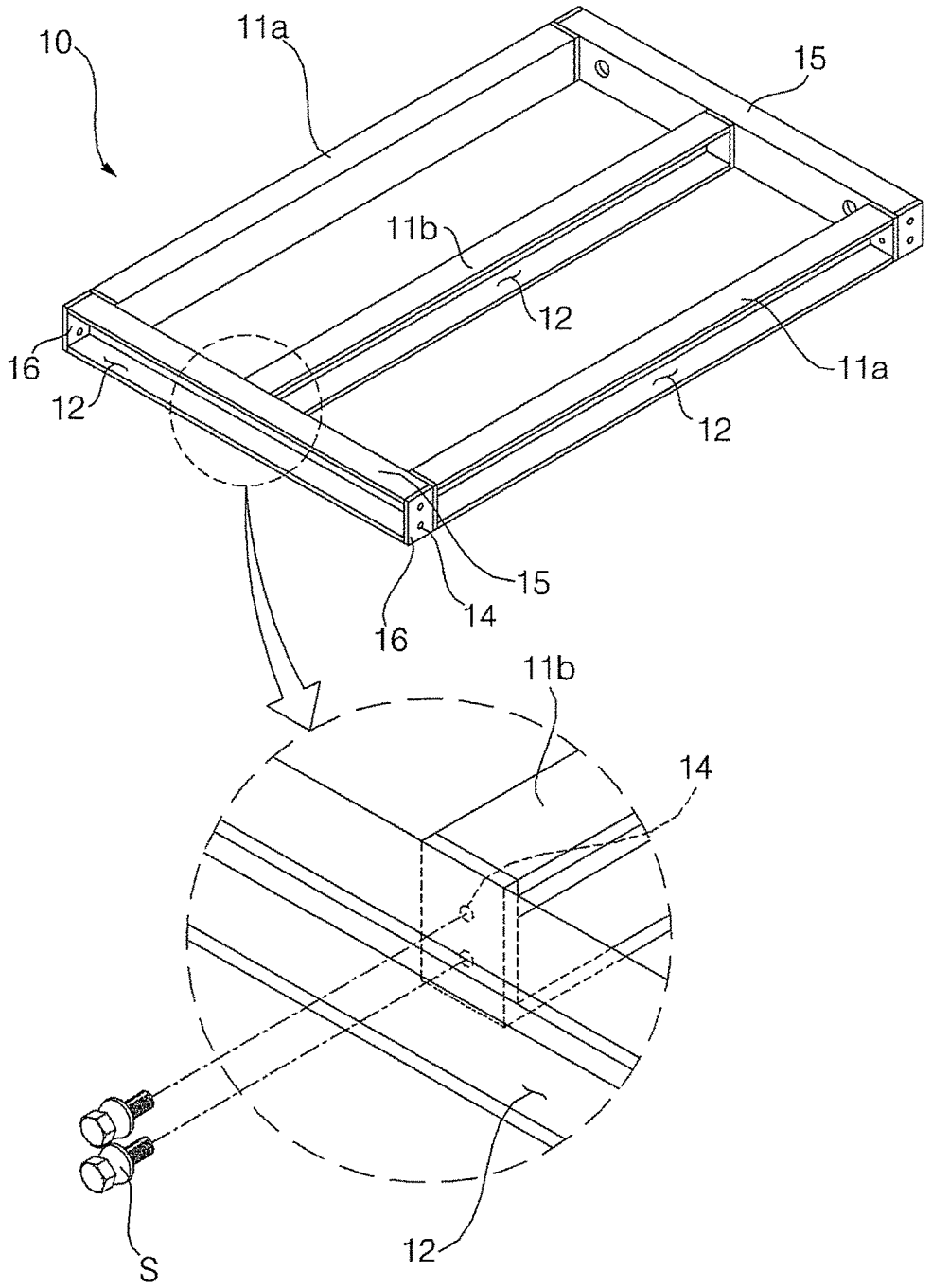
FIG. 10 is a perspective view showing a common base included in each module of FIG. 1.
Figure 11:
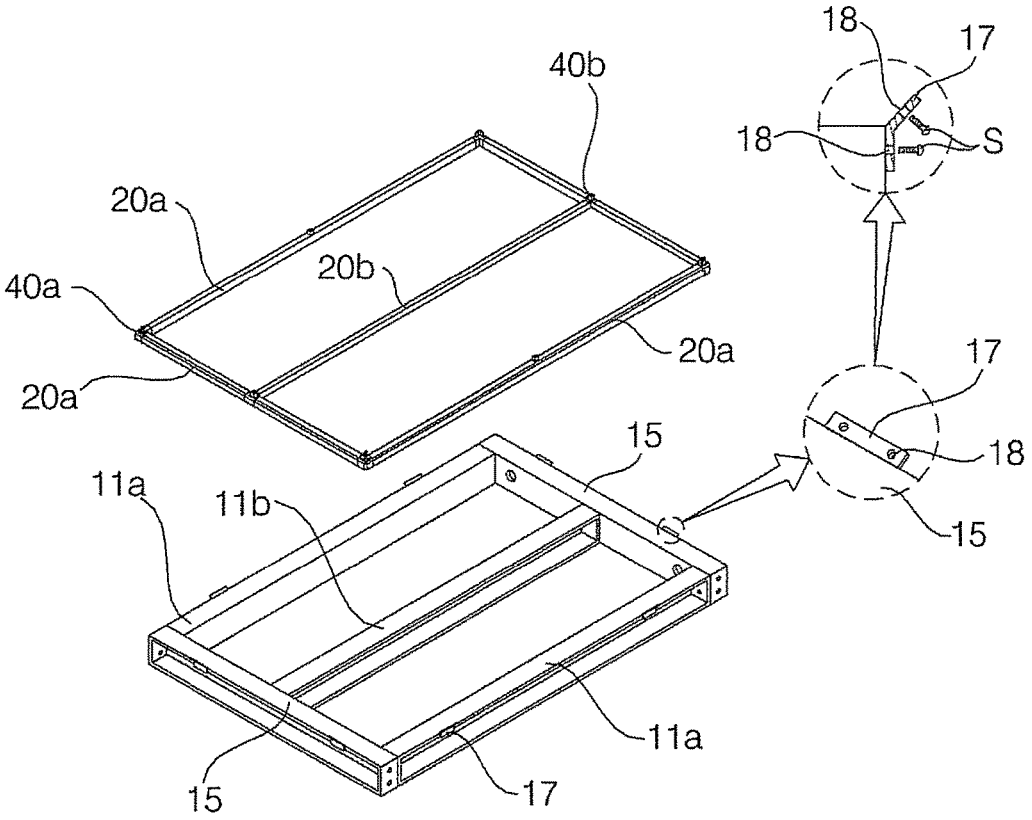
FIG. 11 is an exploded perspective view showing a coupled form of the base of FIG. 10 and a lower cover.
Figure 12:
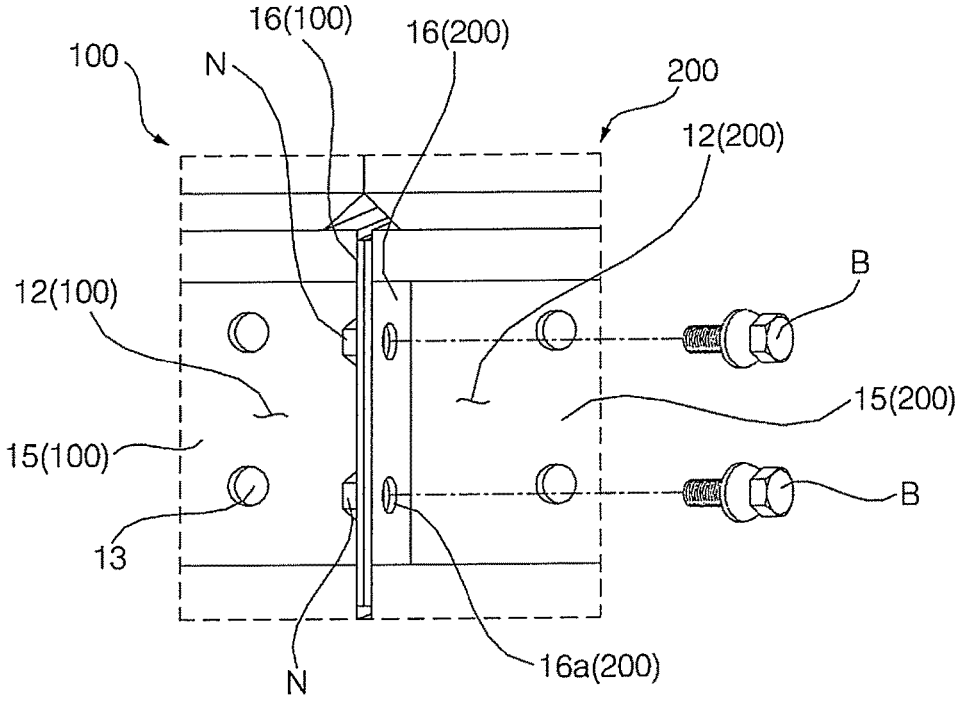
FIG. 12 is a partial perspective view showing a coupled form of modules of FIG. 1 using bases thereof.

FIG. 10 is a perspective view showing a common base included in each module of FIG. 1. FIG. 11 is an exploded perspective view showing a coupled form of the base of FIG. 10 and a lower cover. FIG. 12 is a partial perspective view showing a coupled form of modules of FIG. 1 using bases thereof.

The base 10 may be a lowermost element of the module, and serve to support a weight of the entire module. The base 10 may be a combination of a plurality of base frames 11*a*, 11*b*, and 15. With reference to FIG. 10, the base frames 11*a*, 11*b*, and 15 may be elongated in a longitudinal direction thereof and have a "ㄷ"-shaped cross section, one longitudinal side of which is open. The base frames 11*a*, 11*b*, and 15 may be arranged such that the open side 12 of each base frame is oriented outward and may be assembled with one another using screws S. The base 10 may have an approximately rectangular shape to allow the rectangular parallelepiped module to be stably disposed thereon, and the one or more base frames 11*a*, 11*b*, and 15 may be arranged substantially in parallel at a center of the base 10 as needed to effectively support any one of modules having various sizes and weights thereon.

The base 10, with reference to FIG. 10, may be assembled such that the open sides 12 of all of the base frames 11*a*, 11*b*, and 15 are oriented outward. This serves to facilitate assembly between the modules, as will be described hereinbelow.

More specifically, the base frames 11*a*, 11*b*, and 15 may have first screw fastening holes 14 formed in both ends thereof for fastening of the screws S. In addition, second screw fastening holes (13, see FIG. 12) corresponding to the first screw fastening holes 14 formed in both ends of the base frames 11*a*, 11*b*, and 15 may be formed in ends of the open sides 12 of the base frames 11*a*, 11*b*, and 15. When the base frames 11*a*, 11*b*, and 15 are assembled with one another to form the rectangular base 10, one side of which may be longer, the base frames 11*a*, 11*b*, and 15 may include first base frames 11*a* forming longer sides, second base frames 15 forming shorter sides, and a middle base frame 11*b* that interconnects the second base frames 15 for rigidity enhancement.

With reference to FIG. 11, the base 10, which may have a rectangular shape via a combination of the base frames 11*a*, 11*b*, and 15, may be provided at an upper end rim thereof with a plurality of mounting brackets 17 spaced apart from one another by a predetermined distance. The plurality of mounting brackets 17 may serve to assist coupling of screws S and the rim of the lower cover 30*a* of the module. It should be understood that the respective mounting brackets 17 may have screw fastening holes 18 to couple the screws S through the lower cover 30*a* and the base 10. Upper ends of the plurality of mounting brackets 17 may be bent to come into surface contact with a slope, which may be formed at a rim of the lower cover 30*a*.

According to one embodiment of the air handler, as described above, after modules for differentiated functions of an air conditioning cycle are completed, respectively, via simplified sliding coupling between the module frames 20 and the case panels 30, as exemplarily shown in FIGS. 1 and 2, the air suction module 100, the mixing module 200, the heat exchange module 300, and the air discharge module 400 may be hermetically coupled to one another to prevent leakage of air while being in communication with one another.

More specifically, with reference to FIG. 12, the base frames 11*a*, 11*b*, and 15 forming the base 10 may have a "ㄷ"-shaped cross section to form the open side 12, and connection flanges 16 for interconnection of the bases 10 of the respective modules may be formed at both ends of the base frames 11*a*, 11*b*, and 15. The connection flanges 16 of each module may be provided with bolt fastening holes 16*a* that communicate with the open side 12 of each of the base frames 11*a*, 11*b*, and 15. In a state in which the connection flanges 16 of the respective modules come into surface contact with one another, bolts B may penetrate the bolt fastening holes 16*a* and nuts N may be fastened to the bolts B to interconnect the respective modules. Although the bolt fastening holes 16*a* may be replaced with the above-described screw fastening holes 14, the bolt fastening holes 16*a* may be formed separately from the screw fastening holes 14. In this way, as the modules 100, 200, 300, and 400, which may be respectively assembled on a per function basis, may be arranged in sequence, and the bases 10 of the respective modules interconnected, the air handler 1 according to embodiments capable of forming a single air conditioning cycle may be completed.

Figure 13A:
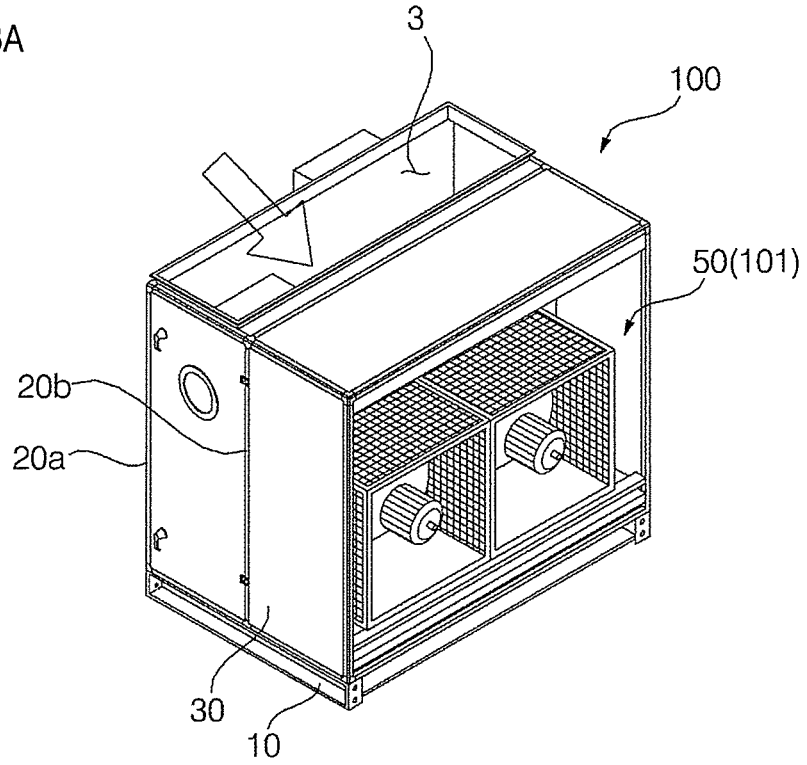
FIGS. 13A-13B are perspective views showing an air suction module and an air discharge module of FIG. 1, both of which are configured to receive a fan module.
Figure 13B:
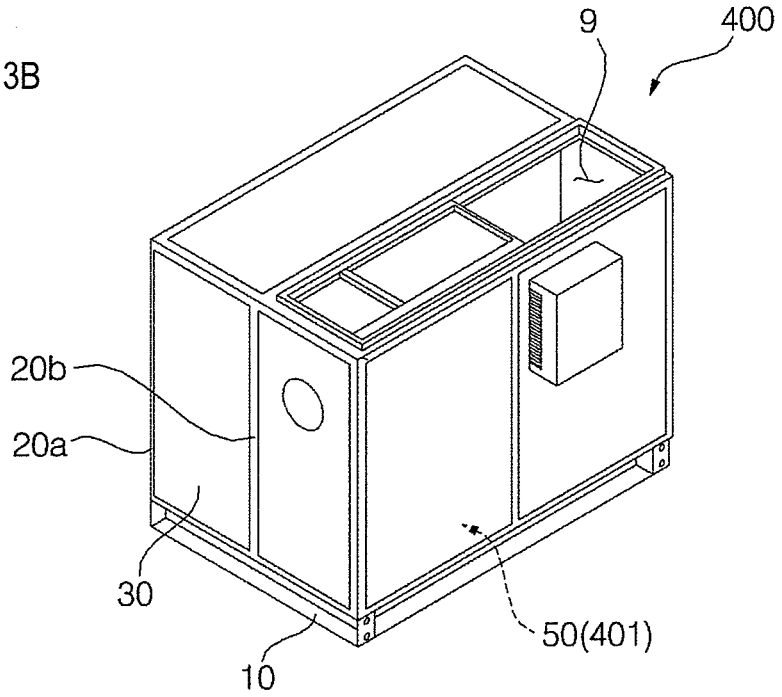
Figure 14A:
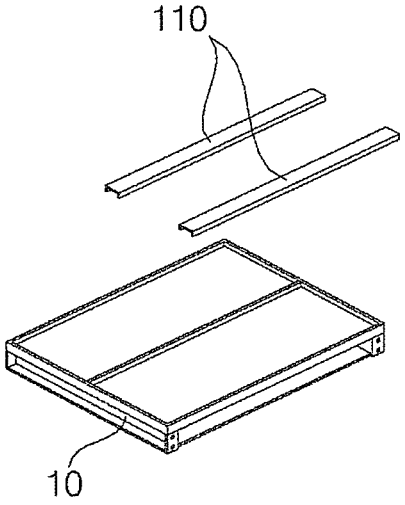
FIGS. 14A-14B is are perspective views showing a preparation operation to install a fan module to a base.
Figure 14B:
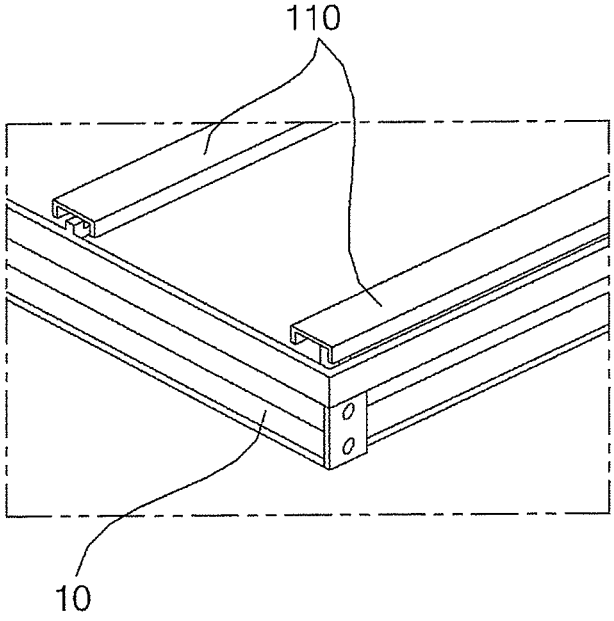
Figure 15:
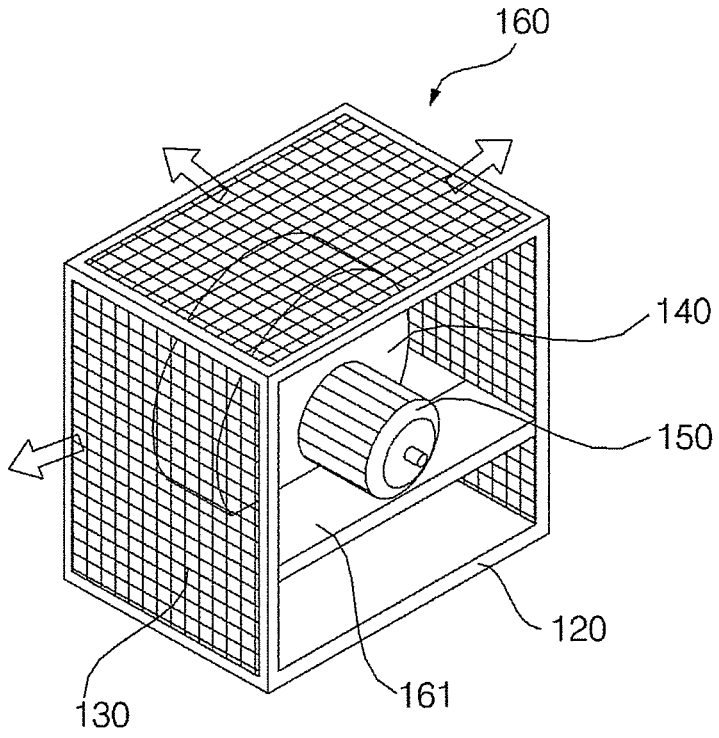
FIG. 15 is a perspective view of the fan module of FIGS. 13A-13B.
Figure 16:
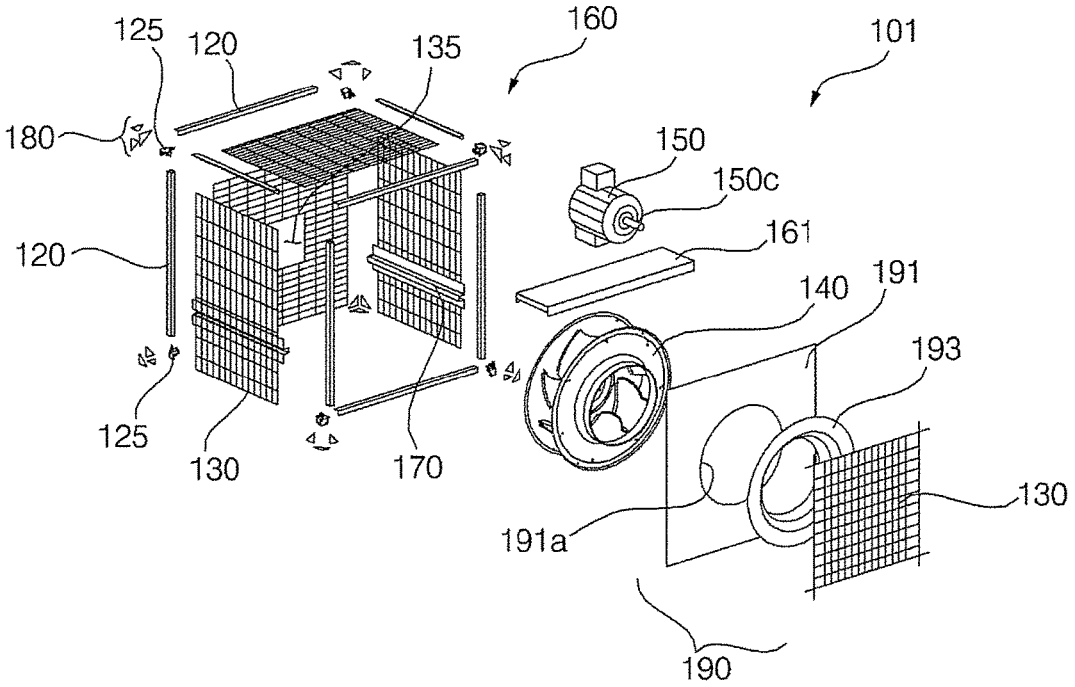
FIG. 16 is an exploded perspective view of the fan module of FIG. 15.
Figure 17:
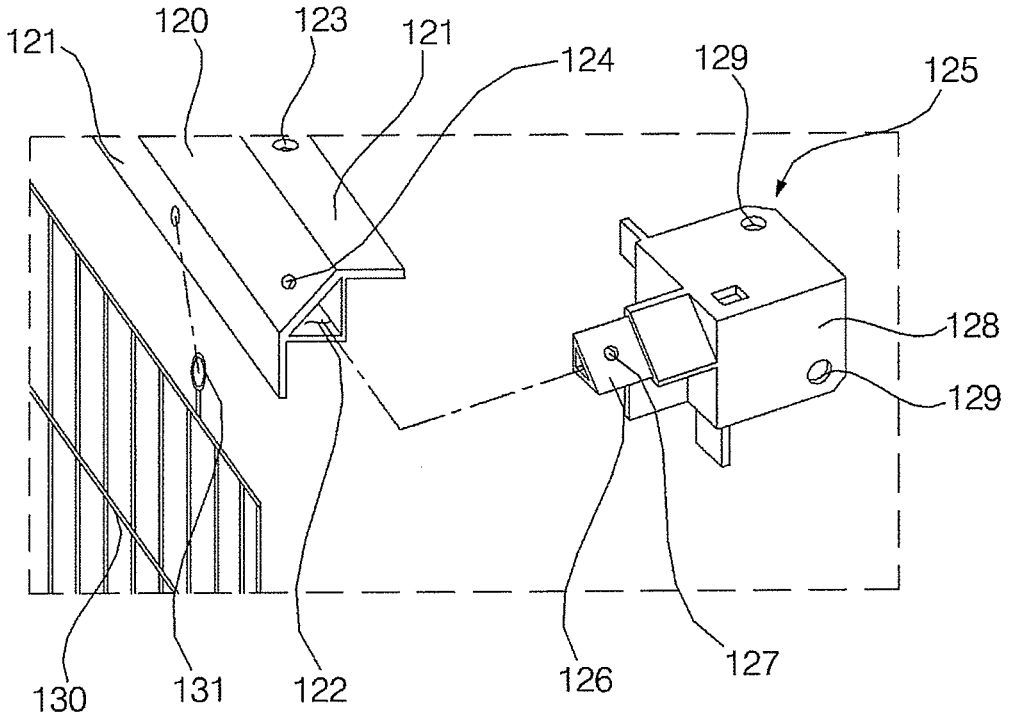
FIG. 17 is an exploded perspective view showing an installation relationship between a box frame, a box frame connector, and a safety net of the fan module of FIG. 15.
Figure 18:
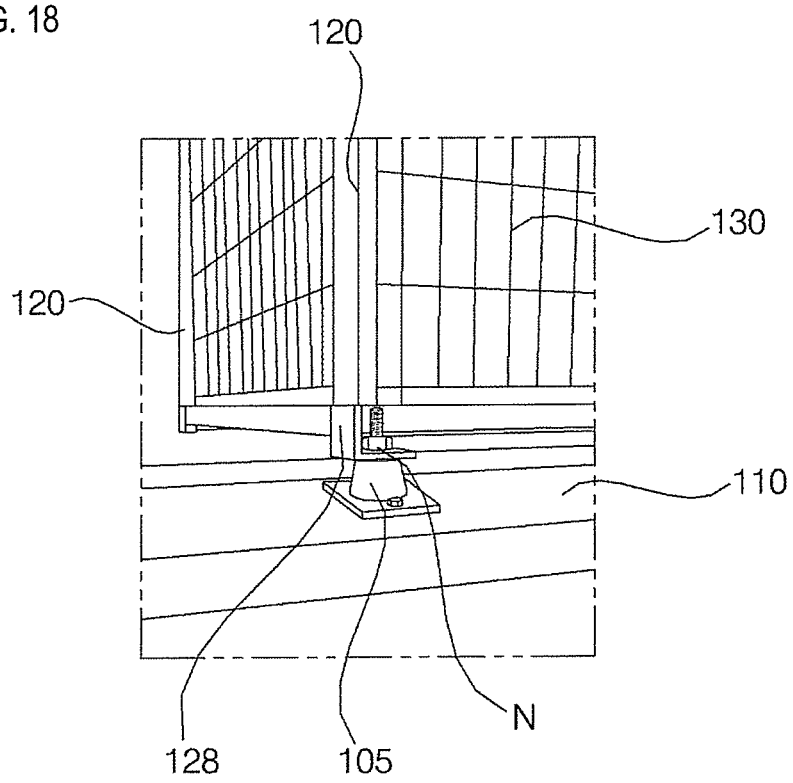
FIG. 18 is a perspective view showing a coupled form of the fan module of FIG. 15 and a lower cover.
Figure 19:
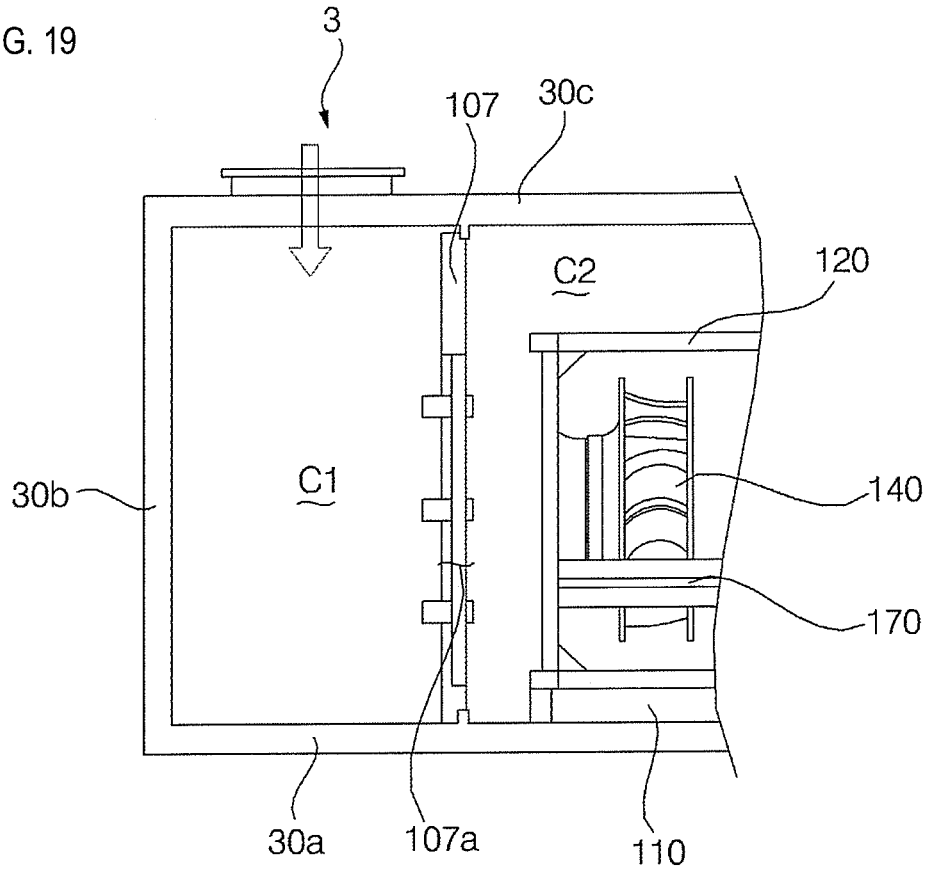
FIG. 19 is a partial sectional view showing an interior of the air suction module or the air discharge module according to embodiments, which may be divided into an air suction chamber and a centrifugal chamber by a separation partition.
Figure 20:
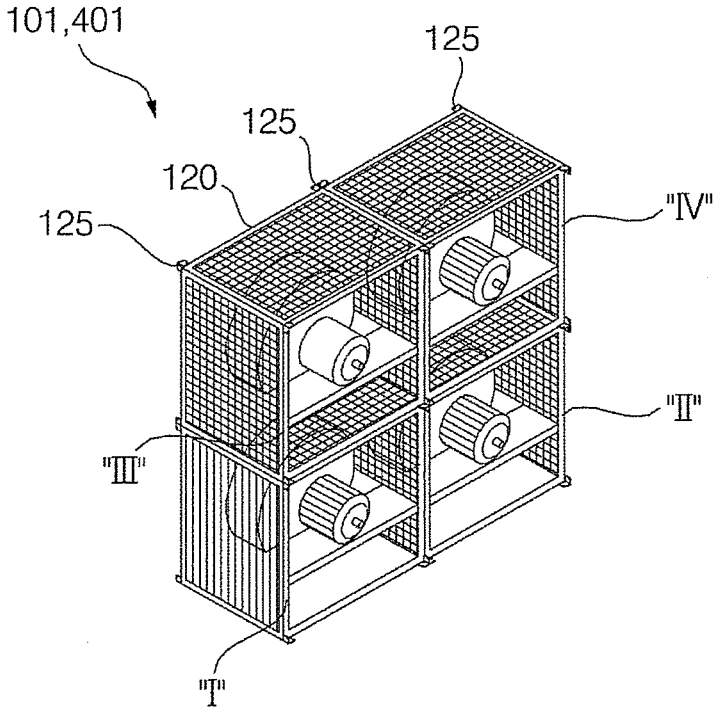
FIG. 20 is a perspective view showing a stacked installation form of fan modules according to embodiments.

FIGS. 13A-13B are perspective views showing an air suction module and an air discharge module of FIG. 1, both of which are configured to receive a fan module. FIGS. 14A-14B are perspective views showing a preparation operation to install a fan module to a base. FIG. 15 is a perspective view of the fan module of FIGS. 14A-14B. FIG. 16 is an exploded perspective view of the fan module of FIG. 15. FIG. 17 is an exploded perspective view showing an installation relationship between a box frame, a box frame connector, and a safety net of the fan module of FIG. 15. FIG. 18 is a perspective view showing a coupled form of the fan module of FIG. 15 and a lower cover. FIG. 19 is a partial sectional view showing an interior of the air suction module or the air discharge module according to embodiments, which may be divided into an air suction chamber and a centrifugal chamber by a separation partition. FIG. 20 is a perspective view showing a stacked installation form of fan modules according to embodiments.

According to one embodiment, the air handler 1, as described above, which may include the air suction module 100 having the suction opening 3 for suction of indoor air and accommodating fan module 101 to move the suctioned indoor air, the mixing module 200 coupled to and in communication with the air suction module 100 and mixing the indoor air supplied from the air suction module 100 and outside air suctioned from the outside, the heat exchange module 300 coupled to and in communication with the mixing module 200 and exchanging thermal energy with the mixed air supplied from the mixing module 200, and the air discharge module 400 coupled to and in communication with the heat exchange module 300 and accommodating the fan module 401 to discharge the heat-exchanged air supplied from the heat exchange module 300 to a room through the discharge opening 9. The components 50 for differentiated functions may be incorporated in inner spaces of the respective modules. The components 50 for differentiated functions may be installed in the most efficient manner in the inner spaces of the respective modules having a standardized shape.

First, the air suction module 100 and the air discharge module 400 will be described hereinbelow in detail with reference to FIGS. 13A to 19.

The air suction module 100 and the air discharge module 400, with reference to FIGS. 13A-13B, may respectively include a suction chamber C1 for suctioning in air and a centrifugal chamber C2 separated from the suction chamber C1 by a separation partition 107, the fan module 101 or 401 being installed in the centrifugal chamber C2 (see FIG. 19).

The separation partition 107 may be one of the case panels 30 slidably coupled to the middle frame 20*b* in the same manner as the other case panels 30. More specifically, the separation partition 107 may be one of the case panels 30, both ends of which may be vertically slidably inserted into and coupled to the module frames 20 forming the framework of the module. As such, the separation partition 107 may separate the suction chamber C1 and the centrifugal chamber C2 from each other in a direction substantially perpendicular to a flow direction of conditioned air.

The separation partition 107 may be slidably coupled to the module frames 20 located, respectively, between two case panels 30, that is, the middle frames 20*b*. More specifically, the separation partition 107 may be slidably coupled to the middle frame 20*b* on the lower cover 30*a* formed by dividing a lower surface of the module into two sections and may also be slidably coupled between the middle frames 20*b* vertically extending upward from the middle connectors 41*b* located at both ends of the middle frame 20*b* on the lower cover 30*a*.

The separation partition 107 may have a rectangular communication opening 107*a* for communication between the suction chamber C1 at a first side of the separation partition 107 and the centrifugal chamber C2 at a second side of the separation partition 107. The communication opening 107*a* may not be limited to the rectangular shape and may have any of various other shapes.

The separation partition 107 may be mounted on the lower cover 30*a* forming a lower surface of the air suction module 100 or the air discharge module 400. More specifically, the lower cover 30*a* may be formed by two case panels 30 horizontally coupled, respectively, to a first side and a second side of the middle frame 20*b* that crosses a middle portion of the lower cover 30*a* in a direction substantially perpendicular to a flow direction of conditioned air, and the separation partition 107 may be coupled to the lower cover 30*a* such that the sliding rib 21' or 21" protruding upward from the middle frame 20*b* on the lower cover 30*a* may be inserted into the sliding rail groove 31 formed in a lower end of the separation partition 107. In addition, the separation partition 107 may be further provided at both lateral ends thereof with the sliding rail grooves 31, such that the sliding ribs 21' or 21" of the middle frames 20*b* vertically connected to the middle connectors 40*b* at both ends of the middle frame 20*b* on the lower cover 30*a*, may be inserted into the respective sliding rail grooves 31 to allow the separation partition 107 to be slidably coupled to the middle frames 20*b*.

The fan module 101 or 401 accommodated in the centrifugal chamber C2 may be connected to the separation partition 107 through the communication opening 107*a*. The fan module 101 or 401, which may be connected to the separation partition 107 and accommodated in the centrifugal chamber C2, may serve to create centrifugal force by suctioning in air from the suction chamber C1 to the centrifugal chamber C2 and discharging the air to another neighboring module (for example, the mixing module 200) or to the outside.

The fan module 101 or 401, with reference to FIGS. 15 and 16, may include a centrifugal fan 140 to create the aforementioned suction force and centrifugal force, a fan motor 150 to apply torque to the centrifugal fan 140, and a fan box 160 having an installation space for the centrifugal fan 140 and the fan motor 150. The fan box 160 may be located in the centrifugal chamber C2 at one side of the separation partition 107 so as to be spaced from the separation partition 107. The fan box 160 may include a plurality of box frames 120 that form the framework of the fan box 160, and safety nets 130 installed on the box frames 120 to form surfaces of the fan box 160, the safety nets 130 serving to protect rotation of the centrifugal fan 140.

The separation partition 107 and the fan box 160 may be connected to each other to allow air suctioned through the communication opening 107*a* to move to the centrifugal fan 140. That is, the fan box 160 may be coupled to the communication opening 107*a* of the separation partition 107 to allow interior air of the suction chamber C1 to wholly pass through the centrifugal fan 140 installed in the fan box 160 of the centrifugal chamber C2. This will be described hereinbelow in detail.

The fan box 160 may be assembled into a predetermined external appearance of a framework using a box frame connector 125 that interconnects two or more box frames 120 at each corner of the box frame 160. The fan box 160 may have a rectangular parallelepiped shape internally defining a predetermined installation space for the centrifugal fan 140 and the fan motor 150. The box frame connector 125 may be located at each corner of the rectangular parallelepiped frame box 160 to interconnect three box frames 120 substantially perpendicular to one another.

With reference to FIG. 17, the box frames 120 may be, for example, formed of iron, have a triangular hollow section 122, and include extensions 121 substantially parallel to respective surfaces of the fan box 160. A portion 126 of the box frame connector 125 may be inserted into the triangular hollow section 122 so as to overlap a portion of the box frame 120. As screws S are fastened through screw fastening holes 124 and 127 formed, respectively, in the portion 126 of the box frame connector 125 and the overlapped portion of the box frame 120, the box frame 120 and the box frame connector 125 may be assembled with each other.

The box frame connector 125 may have an outwardly extending fan box connection end 128 for connection of neighboring fan modules 101 or 401 when a plurality of fan modules 101 or 401 is stacked one above another or arranged side by side in the centrifugal chamber C2. The fan box connection end 128 may have a "┐"-shaped or "└"-shaped form to extend in substantially vertical and horizontal directions. As such, the fan box connection end 128 may be used to interconnect the fan modules 101 or 401 arranged side by side, as well as the fan modules 101 or 401 stacked one above another. The fan box connection end 128 may have a screw fastening hole 129 to allow a screw S to be fastened through the screw fastening holes 129 of neighboring fan box connection ends 128. The fan box connection end 128 may be integrally formed with the box frame connector 125 and may also be prefabricated separately from the box frame connector 125 and then separably connected to the box frame connector 125 or the box frame 120 as needed.

The safety nets 130 may take the form of a mesh formed, for example, by welding a plurality of iron wires, or by weaving the iron wires to make knots. The safety nets 130 may be coupled to the framework formed by the box frames 120 to form surfaces of the fan box 160, as described above.

The safety nets 130 may function to protect rotation of the centrifugal fan 140 installed in the fan box 160 and rotated at high speeds. In addition, the safety nets 130 may serve to pass air to assist the case panels 30 forming surfaces of the centrifugal chamber C2, rather than a fan housing enclosing the centrifugal fan 140, in guiding movement of air by static pressure generated by rotation of the centrifugal fan 140. This is based on the principle that a predetermined static pressure is generated when the centrifugal fan C2 is filled with moving air. As the safety nets 130 pass air suctioned by the centrifugal fan 140 and movement of the air is substantially guided by the case panels 30 of the module forming the centrifugal chamber C2, a separate fan housing is not necessary.

The safety nets 130 may be coupled to the box frames 120 so as to form surfaces of the rectangular parallelepiped fan box 160 except for a surface of the fan box 160 adjacent to the separation partition 107 and a lower surface of the fan box 160. This is because a fan shield 191, which will be described hereinbelow, may be coupled to the surface of the fan box 160 adjacent to the separation partition 107, and the lower surface of the fan box 160 may not be involved in protection of rotation of the centrifugal fan 140.

With reference to FIG. 17, each safety net 130 may include a plurality of outwardly extending connection rings 131 spaced apart from one another by a predetermined distance along the rim of the safety net 130 so as to be inserted into screw holes 123 formed in the extension 121 of the box frame 120. The connection rings 131 may be formed by bending some of the iron wires into a rounded form, and may also be prefabricated as separate members, and then, may be attached to the rim of the safety net 130. The connection rings 131 may assist installation of the safety net 130 to the box frame 120, as screws S are fastened through the screw holes 123 of the box frame 120. After the safety net 130 is installed to the box frame 120, corner-shaped support members 180 may be coupled to support corners of the fan box 160.

The fan module 101 or 401 having the above-described configuration, with reference to FIGS. 14A-14B, may be installed above the lower cover 30*a* disposed on the base 10 and a pair of fan module brackets 110 mounted on the lower cover 30*a* so as to be spaced apart substantially in parallel from each other by a predetermined distance. The fan module brackets 110 may serve to prevent the fan module 101 or 401 from being directly disposed on the lower cover 30*a* so as to come into contact with the lower cover 30*a*. With reference to FIG. 18, the fan module bracket 110 may be coupled to the fan box connection end 128 of each box frame connector 125 located at a lower end of the fan box 160 with a vibration absorbing block 105 interposed therebetween, which may prevent vibration caused by operation of the centrifugal fan 140 of the fan module 101 or 401 from being directly transmitted to the lower cover 30*a*.

Figure 21:
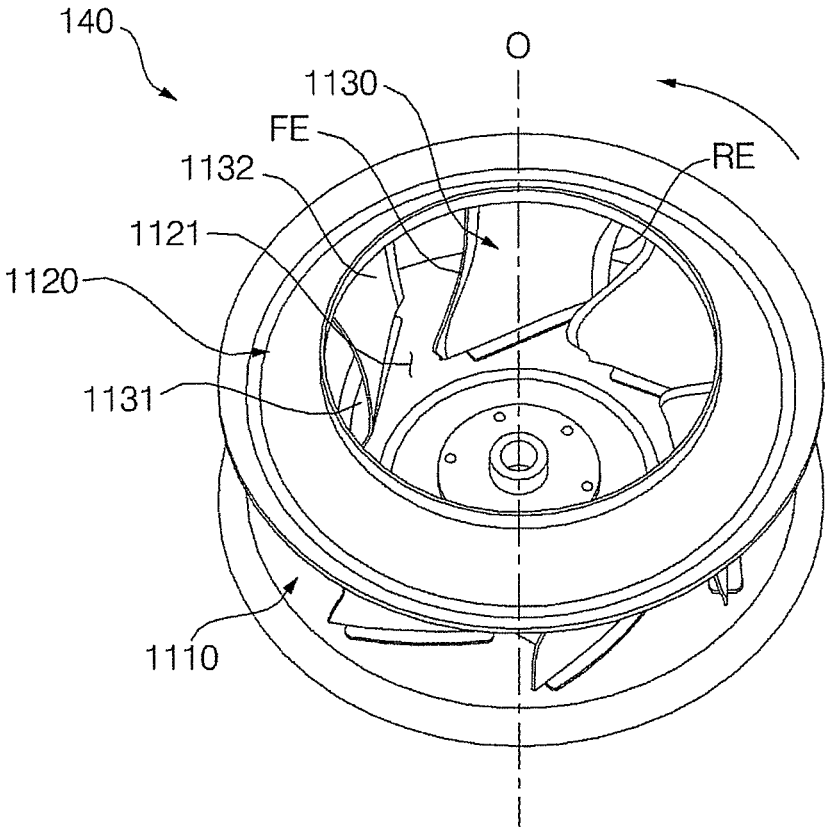
FIG. 21 is a perspective view showing a centrifugal fan of the fan module of FIG. 15.
Figure 22A:
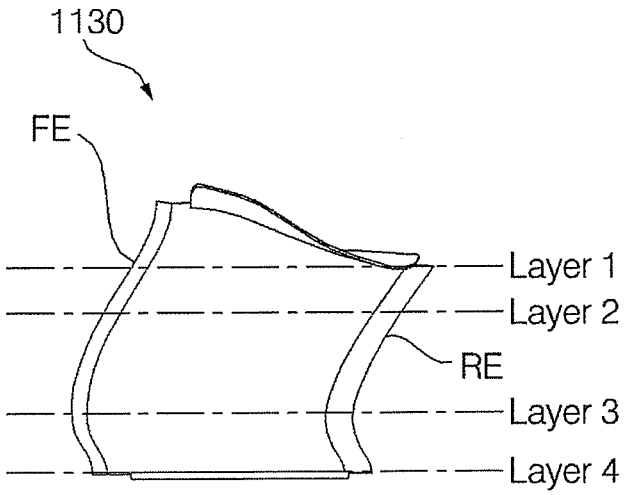
FIGS. 22A-22B are sectional views showing vertical cross sections of a blade included in the centrifugal fan of FIG. 21.
Figure 22B:
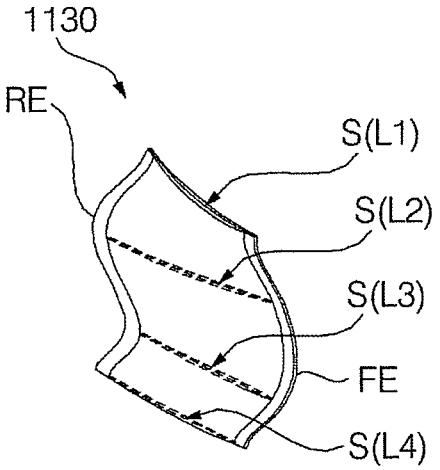

FIG. 21 is a perspective view showing the centrifugal fan of the fan module of FIG. 15. FIGS. 22A-22B are sectional views showing vertical cross sections of a blade included in the centrifugal fan of FIG. 21.

Generally, the centrifugal fan 140 is a fan that accelerates air introduced in an axial direction through a fan shroud 1120 and discharges the air in a radial direction through gaps between blades 1130 by centrifugal force. Performance of the centrifugal fan 140 may be affected by various shape factors, as well as friction loss, and shock loss, for example.

According to one embodiment of the air handler 1, the centrifugal fan 140, which may be one component of the fan module 101 or 401, may be configured such that an upper portion 1132 of each blade 1130 defines a section that is concave toward a rotational axis O, and a lower portion 1131 of the blade 1130 may define a section that is convex in a direction opposite to the rotational axis O. This shape of the blade 1130 may reinforce airflow at the lower portion 1131 of the blade 1130 and ensure even airflow between the upper and lower portions 1132, 1131 of the blade 1130, which may provide the centrifugal fan 140 with reduced noise generation and greatly enhanced performance in comparison to conventional fans having a same size or volume.

More specifically, the centrifugal fan 140, with reference to FIG. 21, may include a pair of main plates 1110 configured to be rotated about the rotational axis O, the fan shroud 1120 having an air suction hole 1121 and the blades 1130 arranged in a circumferential direction between the main plates 1110 and the fan shroud 1120, such that air suctioned through the suction hole 1121 moves from front edges FE to rear edges RE of the blades 1130.

With reference to FIGS. 22A-22B, assume that layers Layer 1 to Layer 4 of each blade 1130, taken in sequence from the fan shroud 1120 to the main plates 1110, have a first cross section S(L1), a second cross section S(L2), a third cross section S(L3), and a fourth cross section S(L4). In this case, a front edge of the first cross section S(L1) may be farther from the rotational axis O than a front edge of the fourth cross section S(L4), a rear edge of the first cross section S(L1) may be closer to the rotational axis O than a rear edge of the fourth cross section S(L4). In addition, among rear edges of the respective cross sections, a rear edge of the second cross section S(I2) may be located farthest away from the rotational axis O, and the rear edge of the third cross section S(L3) may be closest to the rotational axis O.

The blades 1130, with reference to FIG. 21, may have a 3D shape. The 3D shape of the blades 1130 may be defined as a shape in which, when cross sections of the blade 1130 taken at predetermined layers corresponding to predetermined planes substantially perpendicular to the rotational axis O are projected onto a predetermined projection plane in a direction of the rotational axis O, two or more lines among lines interconnecting the front edges FE and the rear edges RE of the respective cross sections in the projection plane do not overlap each other.

It was found from experiment that the centrifugal fan 140 having the 3D shape of the blades 1130 as described above has increased static pressure, as well as efficiency depending on a same air volume in comparison to conventional centrifugal fans. More particularly, the centrifugal fan 140 has maximum efficiency up to approximately 82% in comparison to an efficiency of approximately 70% of the related art based on the same air volume. Such enhancement in performance of the centrifugal fan allows the fan to be driven at a lower speed than the related art with respect to the same air volume. In turn, that this lower driving speed is possible means that the air handler 1 according to embodiments may be sufficiently driven by a lower driving load of the fan motor 150 upon high speed driving under the same conditions.

According to one embodiment of the air handler 1, a single fan module 101 or 401 may be installed in the centrifugal chamber C2 and a plurality of fan modules 101 or 401 may be vertically or horizontally arranged substantially in parallel in the centrifugal fan C2 to suit a continuously variable target load of an air conditioning object space. This is because the fan motor 150 and the centrifugal fan 140 having the 3D shape are reduced in volume, and thus, it is unnecessary to construct a large size fan module having installation and transportation inconvenience.

An assembly structure of the fan module 101 or 401 having a unique modular configuration according to embodiments will be described hereinbelow in detail in consideration of the centrifugal fan 140 having the unique 3D shape employed in the air handler 1 according to embodiments.

The fan module 101 or 401, with reference to in FIGS. 15 and 16, may include the centrifugal fan 140, which may suction in air from the suction chamber C1 into a space between the main plates 1110 vertically oriented and spaced apart from each other in a direction of the rotational axis and radially discharge the air to the centrifugal chamber C2 through gaps between the blades 1130 interconnecting the main plates 1110; the fan motor 150, which may apply torque to the centrifugal fan 140 and which may be linearly coaxial with the rotational axis of the centrifugal fan 140; the fan box 60 having an installation space for the centrifugal fan 140 and the fan motor 150, and a guide 190 installed in the fan box 160 and defining an air introduction passage from the suction chamber C1 to the space between the main plates 1110 of the centrifugal fan 140.

The centrifugal fan 140 has the above-described 3D shape, and thus, requires a relatively small size or small volume for generation of the same air volume. The centrifugal fan 140 may be rotated in the fan box 160, which forms the fan module 101 or 401, thereby creating airflow power for suctioning in air from the suction chamber C1 and for discharging the air from the centrifugal chamber C2.

The fan module 101 or 401 may further include a motor bracket 170 for the fan motor 150, which may have a smaller vertical height than a vertical height of the centrifugal fan 140, installed in the fan box 160 such that a rotational shaft 150*c* of the fan motor 150 may be horizontally coaxial with the rotational center of the centrifugal fan 140.

With reference to FIG. 16, a pair of the motor brackets 170 may be spaced apart from each other in the fan box 160, and the fan module 101 or 401 may further include a support plate 161 connected at both ends thereof to the respective motor brackets 170 to support the fan motor 150 disposed thereon.

The motor brackets 170 may be installed, respectively, to both surfaces of the fan box 160, adjacent to an air suction surface of the fan box 160, at a same height to extend a predetermined length in a substantially horizontal direction. The support plate 160 may be coupled to the pair of motor brackets 170 such that lower surfaces of first and second ends of the support plate 160 may be supported by upper surfaces of the motor brackets 170.

The fan motor 150 may be firmly mounted on the support plate 160 such that the rotational shaft 150*c* of the fan motor 150 may be linearly coaxial with the rotational center of the centrifugal fan 140. The support plate 160 must be designed to support a weight including a weight of the fan motor 150 and a weight of the centrifugal fan 140 coaxially connected to the fan motor 150.

For easy installation of the fan motor 150, one of the safety nets 130, that is, the safety net 130 adjacent to the fan motor 150 may have a motor fitting hole 135 provided therein for penetration of the fan motor 135. This provides repair convenience by enabling repair or replacement of the fan motor 150 without separation of the safety net 130. However, the motor fitting hole 135 is not absolutely necessary.

The guide 190 may include an air guide 193 connected to the fan shroud 1120 formed at a suction portion of the centrifugal fan 140 to guide suction of air into the space between the main plates 1110, and a fan shield 191 connected to an edge of the fan box 160 and having a hole 191*a* in communication with the air guide 193. The fan shroud 1120 may be integrally formed with the centrifugal fan 140 and protrude from the suction portion along the rim of the circular suction hole 1121 formed in one of the main plates 1110 through which air may be suctioned.

The air guide 193 may not be directly connected to an end of the fan shroud 1120 protruding from the suction portion for rotation of the centrifugal fan 140, but rather, may serve to naturally guide air from the suction chamber C1 to the centrifugal fan 140. The air guide 193 may be secured to the fan shield 191 so as to communicate with the hole 191*a*.

The fan shield 191 may be installed to an external surface of the fan box 160 instead of the safety net 130, thereby serving to protect the centrifugal fan 140. In addition, the fan shield 191 may serve to provide an installation space for the air guide 193, as described above, and to prevent air suctioned in from the suction chamber C1 from leaking to the centrifugal chamber C2 except for the fan box 160.

The guide 190 may further include an air guide tunnel (not shown) for connection between the communication opening 107*a* of the separation partition 107 and the fan box 160. The air guide tunnel may serve to shield a space between the separation partition 107 and the fan module 101 or 401 (more particularly, the fan shield 191) from the outside to allow air to move to the centrifugal chamber C2 through the communication opening 107*a* of the separation partition 107 due to the centrifugal fan 140 without leakage of the air. In addition, the air guide tunnel may serve to absorb vibration transmitted from the centrifugal fan 140 to the separation partition 107.

According to one embodiment of the air handler 1 having the above-described configuration, a target load of an air conditioning object space in which the air handler 1 is installed may differ in every building. It should be understood that the number of fan modules 101 and 401 installed in the air suction module 100 and the air discharge module 400 may be determined in consideration of a target load, and air conditioning design conditions required by designers, and thus, a plurality of fan modules I, II, III and IV may be provided as shown in FIG. 20. Although FIG. 20 shows an embodiment in which four fan boxes 160 are stacked one above another or arranged side by side by the fan box connection ends 128, embodiments are not limited thereto, and a greater number of fan boxes 160 may be stacked one above another or arranged side by side. In a case in which providing the fan boxes 160 to suit a target load is difficult due to a limited space of the centrifugal chamber C2, as described above, it is possible to increase a volume of the entire module using the middle frames 20B among the module frames 20.

In the related art, a large capacity centrifugal fan and a relatively heavy fan motor to drive the centrifugal fan are used. Belt and pulley driving is adopted as a power transmission to ensure stable installation of the heavy fan motor and stable provision of torque from the fan motor in consideration of a large weight of the fan motor, and a fan housing that encloses the centrifugal fan is required to guide airflow in such a way that air moved by the centrifugal fan is intensively discharged through a given discharge port in order to compensate for power loss caused by the belt and pulley driving. This installation and driving of the centrifugal fan and the fan motor according to the related art are adopted based on uncertainty of fan efficiency including a weight and size of the centrifugal fan. The related art requires a larger installation space for the centrifugal fan and the fan motor, in comparison to a case in which a rotational shaft of the fan motor is directly connected to and driven by the centrifugal fan, and also requires the fan housing because it is difficult to achieve constant static pressure via driving of the centrifugal fan. The fan housing may cause bidirectional air suction or unidirectional air suction according to an air suction structure thereof. In the case of unidirectional air suction, the fan housing may have a complicated interior design. In the case of bidirectional air suction, the fan housing may cause considerable deterioration of fan efficiency because of airflow loss at a coupling region of a belt and a pulley.

According to one embodiment of the air handler 1, through provision of the centrifugal fan 140 having the 3D shape, it is possible to eliminate problems of the related art, such as difficult installation of the heavy fan motor required to drive the large capacity centrifugal fan and provision of the fan housing to discharge air in a given direction based on driving of the centrifugal fan. Therefore, the air handler 1 according to embodiments may achieve various advantages, such as cost reduction and creation of a more pleasant air conditioning environment via flexible management of the fan modules 101 and 401 having a reduced size based on a target load of an air conditioning object space.

According to one embodiment of the air handler 1 having the above-described configuration, an assembly procedure of the fan module 101 or 401 will be described hereinbelow.

A fan module assembly method according to one embodiment may include a separation partition assembly step of assembling the separation partition 107, which divides an inner space of the module into the suction chamber C1 at the first side thereof and the centrifugal chamber C2 at the second side thereof, a fan module assembly step of installing and assembling the fan module 101 or 401, in which the centrifugal fan 140 will be rotatably accommodated, in the centrifugal chamber C2 corresponding to the second side of the separation partition 107 assembled by the separation partition assembly step, a centrifugal fan installation step of installing the centrifugal fan 140 and the fan motor 150 in the fan module 101 or 401 assembled by the fan module assembly step, and a fan module connection step of connecting the fan module 101 or 401 and the separation partition 107 to each other to enable movement of air from the suction chamber C1 to the centrifugal fan 140 without leakage of the air after the centrifugal fan installation step.

The separation partition assembly step may be a step in which both ends of one of the case panels 30 may be vertically slidably inserted into and assembled with the module frames 20 forming the framework of the module to divide the inner space of the module into the suction chamber C1 and the centrifugal chamber C2 arranged in sequence in a flow direction of conditioned air. That is, although the separation partition 107 may be prefabricated as a separate member and then coupled to the module frames 20, the separation partition 107 may be one of the case panels 30.

The fan module assembly step may include a fan module bracket installation process of installing the fan module brackets 110 on an upper surface of the lower cover 30*a* forming a lower surface of the module, a fan box forming process of forming the framework of the fan box 160 using the box frames 120 and the box frame connectors 125 and coupling the safety nets 130 to the framework of the fan box 160 to form the fan box 160 after the fan module bracket installation process, and a fan box installation process of mounting the fan box 160 formed by the fan box forming process on the fan module brackets 110.

In the fan box forming process, the framework of the fan box 160 may be formed by locating the box frame connector 125 at each corner of the fan box 160 and inserting three connection ends 126 of the box frame connector 125 arranged substantially perpendicular to one another into the hollow sections 122 formed in the ends of the respective box frames 120 forming edges of the fan box 160. In the fan box forming process, the safety nets 130 may be secured to the extensions 121 of the box frames 120 extending substantially parallel to the surfaces of the fan box 60.

The centrifugal fan installation step may include a motor bracket installation process of installing the motor brackets 170 inside the fan box 160, a support plate installation process of installing the support plate 161 such that both ends of the support plate 161 may be supported by the motor brackets 170, a fan motor installation process of mounting the fan motor 150 on the support plate 161 after the support plate installation process, and a centrifugal fan installation process of installing the centrifugal fan 140 such that the rotational center of the centrifugal fan 140 is linearly coaxial with the fan motor 150 installed by the fan motor installation process.

The fan module connection step may include a fan shield installation process of installing the fan shield 191 having the hole 191*a* in the suction chamber C1 to form one surface of the fan box 160 an air guide installation process of communicating the centrifugal fan 140 with the outside of the fan box 160 using the air guide 193 after the fan shield installation process, the air guide 193 having a first end coupled to and in communication with the hole 191*a* and a second end that extends toward the fan shroud 1120 of the centrifugal fan 140 protruding into the suction chamber C1, and an air flow forming process of shielding a space between the communication opening 107*a* of the separation partition 107 and the fan shield 191 from the outside using the air guide tunnel.

Figure 23:
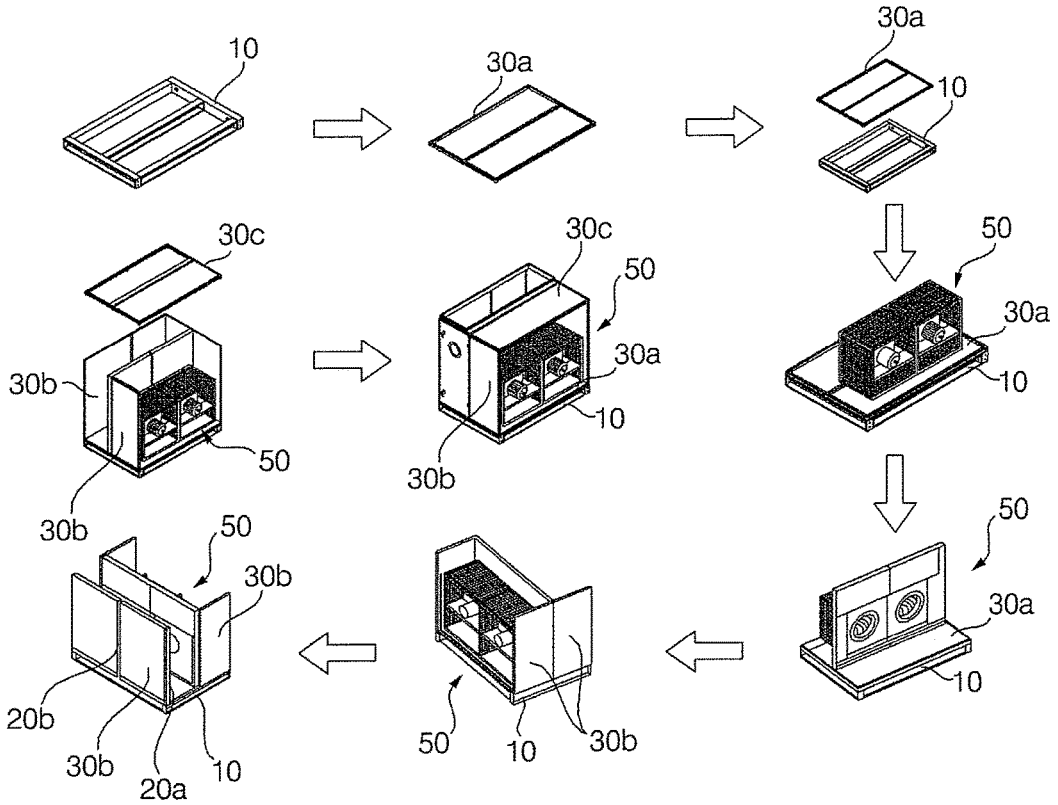
FIG. 23 is a diagram illustrating a method for assembling an air handler according to an embodiment.

FIG. 23 is a diagram illustrating a method for assembling an air handler according to an embodiment. With reference to FIG. 23, the method for assembling the air handler 1 according to an embodiment may include a base forming step of forming the base 10 by assembling the base frames 11*a*, 11*b*, and 15 with one another, a frame assembly step of assembling the module frames 20 with one another on the base 10 formed by the base forming step to form a framework of a module, and a case panel assembly step of slidably inserting the case panels 30 to the framework of the module formed by the frame assembly step to form surfaces of the module.

Although internal components 50, located in each module to provide a differentiated function of the module, may be assembled after the aforementioned frame assembly step, to minimize interference in assembly operation, the internal components 50 may be assembled before the frame assembly step. According to one embodiment of the method for assembling the air handler 1, this assembly may be referred to as an internal component assembly step, and the internal component assembly step may be performed to previously assemble the internal components 50 to be mounted in the module before the frame assembly step.

The case panel assembly step may be a step of coupling one end or both ends of each case panel 30 to the module frames 20, assembled into the rectangular framework having at least one open side, and sliding the case panel toward a closed opposite side of the framework. However, it will be appreciated that the case panels 30 are not absolutely assembled to the previously built module frames 20, and the module frames 20 may be assembled to each case panel 30 to form a rim of the case panel 30 and then the resulting assemblies may be combined with one another. The latter assembly method problematically requires a lot of assemblers due to a relatively large weight of the resulting assembly, and therefore, the former assembly method that allows one or two assemblers to sufficiently assemble the air handler 1 may be advantageous.

Although different internal components 50 may be installed in the respective modules to perform differentiated functions of the modules, the internal component assembly step may be a step of coupling at least the internal components 50, which may fully divide the interior of the module, for example, the separation partition 107 of the air suction module 100 or the air discharge module 400, the damper shield 230 of the mixing module 200 and the wind shield 340 of the heat exchange module 300, to the middle frame 20*b* among the module frames 20 in the same manner as sliding coupling between the case panels 30 and the module frames 20.

The assembly method of the air handler 1 having the above-described configuration according to embodiments will be described below in brief with reference to the accompanying drawings, in particular, FIG. 23.

First, the base 10 to support a weight of each module may be assembled using the base frames 11*a*, 11*b*, and 15. In this case, the open side 12 of each base frame of the base 10 may be oriented outward for simplified coupling of neighboring modules.

Next, the lower cover 30*a*, which has been previously assembled by the module frames 20 and the case panels 30, may be firmly fixed on the base 10. Then, the internal components 50 to be disposed in each module may be assembled before a frame assembly step of forming the framework of the module using the module frames 20. More specifically, with reference to FIG. 28, the fan module 101 or 401, which is the internal component 50 provided in the air suction module 100 and the air discharge module 400, may be first assembled at a position corresponding to the centrifugal chamber C2.

Next, after at least two module frames 20 are vertically connected to both ends of the middle frame 20*b* via the middle connectors 40*b*, as described above, the internal component 50 to divide the interior of the module into at least two spaces, that is, the separation partition 107, the damper shield 230 or the wind shield 340, may be slidably coupled such that both ends thereof are fitted into the two module frames 20, that is, the middle frames 20*b* in the same coupling manner as coupling of the case panels 30.

Then, after the remaining framework of the module is formed using the module frames 20, one end or both ends of each case panel 30 may be coupled to the module frames 20, assembled into the rectangular framework having at least one open side such that the case panel 30 slides toward a closed opposite side of the framework. Thereby, the surface of the module may be completed.

The completed modules as described above, with reference to FIGS. 1 and 2, may be arranged in sequence of the air suction module 100, the mixing module 200, the heat exchange module 300, and the air discharge module 400. Thereafter, as the respective modules are firmly secured to one another so as to prevent leakage of air from the modules using the anti-leakage clamps 60 and coupling portions of the bases 10, assembly of the air handler 1 may be completed.

As is apparent from the above description, embodiments of an air handler having the above-described configuration and a method for assembling a fan module may achieve various effects, including the following.

First, a separation partition to bisect an inner space of an air suction module or an air discharge module may be prepared using one of a plurality of case panels forming a module without using an additional member. This has the effect of enhancing assembly efficiency.

Second, a fan module may be firmly mounted on a lower cover forming a lower surface of a module using fan module brackets, and the separation partition may be coupled to the fan module to ensure natural movement of air suctioned from a suction chamber to a centrifugal chamber by a centrifugal fan. This has the effect of enhancing performance of the centrifugal fan.

Third, modular assembly of the fan module has the effect of enabling rapid and convenient manual assembly.

Effects are not limited to the aforementioned effects and, other not-mentioned effects will be clearly understood by those skilled in the art from the claims.

Embodiments disclosed herein provide an air handling unit or air handler and an assembly method of a fan module which may minimize complicated screw fastening processes upon coupling panels to frames and achieve enhanced hermetic sealing performance.

Embodiments disclosed herein provide an air handling unit or air handler and an assembly method of a fan module, which may reduce a number of constituent elements or components via omission of a complicated configuration and may also reduce overall manufacturing costs via modular delivery and transportation.

Embodiments disclosed herein provide an air handling unit or air handler including a lower cover in the form of a combination of a plurality of module frames and case panels forming a framework and surfaces of a module, the lower cover forming a lower surface of the module, a side cover in the form of a combination of the module frames and the case panels, the side cover forming a side surface of the module, an upper cover in the form of a combination of the module frames and the case panels, the upper cover forming an upper surface of the module, and a separation partition configured to divide an inner space of the module into a suction chamber for introduction of air at one or a first side thereof, and a centrifugal chamber at the other or a second side thereof, the centrifugal chamber accommodating a fan module configured to generate airflow power, the separation partition having a communication opening for communication between the suction chamber and the centrifugal chamber. The separation partition may be one of the case panels having both ends slidably inserted in a substantially vertical direction to the module frames forming the framework of the module so as to divide the inner space of the module into the suction chamber and the centrifugal chamber arranged in sequence in a flow direction of the air.

The air handling unit may further include a base disposed below the module to support a weight of the module. The base may be coupled to the lower cover.

The separation partition may have a lower end slidably coupled to the lower cover, a lateral end coupled to the side cover, and an upper end slidably coupled to the upper cover. The lower cover may be configured to bisect the lower surface of the module by a middle frame, horizontally arranged between two case panels, among the module frames, and the lower end of the separation partition may be slidably coupled to the middle frame.

The side cover may be configured to bisect the side surface of the module by a middle frame, vertically arranged between two case panels, among the module frames. The lateral end of the separation partition may be slidably coupled to the middle frame.

The upper cover may be configured to bisect the upper surface of the module by a middle frame, horizontally arranged between two case panels, among the module frames. The upper end of the separation partition may be slidably coupled to the middle frame.

The upper cover may be selectively slidably coupled to the module frames to form a suction opening for suction of air from the outside to the inner space of the module through the module frames, or to form a discharge opening to discharge air from the inner space of the module to the outside.

The fan module may be accommodated in the centrifugal chamber and suction air from the suction chamber to the centrifugal chamber through the communication opening of the separation partition, and then, may discharge the air to the outside or another module located at one side thereof. The fan module may include a plurality of fan boxes each accommodating a centrifugal fan therein. Each of the fan boxes may include a plurality of linear box frames that form a framework of the fan box, a box frame connector configured to connect at least two of the box frames at a corner of the fan box, and a plurality of safety nets coupled to the framework of the fan box formed by the box frames to form surfaces of the fan box. The fan box may be coupled to and in communication with the communication opening of the separation partition.

The fan box may be coupled to the communication opening of the separation partition to allow interior air of the suction chamber to wholly pass through the centrifugal fan accommodated in the fan box of the centrifugal chamber. The safety nets may be coupled to the box frames to form a rectangular parallelepiped having an open side that faces the suction chamber. The open side that faces the suction chamber may be coupled to a fan shield having a hole. The fan shield may be coupled to the communication opening of the separation partition to shield a space therebetween from the outside.

The safety nets may be coupled to the box frames to form a rectangular parallelepiped having an open side that faces the suction chamber. The open side that faces the suction chamber may be coupled to a fan shield having a hole. The fan shield and the centrifugal fan may be arranged with an air guide interposed therebetween. One or a first end of the air guide may be coupled to the hole, and the other or a second end of the air guide may extend to a fan shroud of the centrifugal fan. The air guide may guide air suctioned from the suction chamber to move into the centrifugal fan.

Each of the box frames may include both hollow ends having a triangular cross section, and an extension that extends substantially in parallel to each surface of the fan box. The box frame connector may have a portion inserted into each hollow end of the box frame at a corner of the fan box, and each of the safety nets may be coupled to the extension.

Embodiments disclosed herein further provide an assembly method of a fan module included in an air handling unit or air handler, the assembly method including assembling a separation partition located to divide an inner space of a module into a suction chamber at one or a first side thereof and a centrifugal chamber at the other or a second side thereof, assembling a fan box in the centrifugal chamber at the other side of the assembled separation partition, a centrifugal fan rotatably received in the fan box, installing the centrifugal fan and a fan motor in the assembled fan box, and connecting the separation partition and the fan box to each other to enable movement of air from the suction chamber to the centrifugal fan after installation of the centrifugal fan.

The assembling of the separation partition may include slidably inserting both ends of one of a plurality of case panels in a substantially vertical direction into a plurality of module frames forming the framework of the module, so as to divide the inner space of the module into the suction chamber and the centrifugal chamber arranged in sequence in a flow direction of air. The assembling of the fan box may include installing a pair of fan module brackets on an upper surface of a lower cover, the lower cover forming a lower surface of the module, forming the fan box, after installation of the fan module, by forming the framework of the fan box using a plurality of box frames and a box frame connector, and coupling a plurality of safety nets to the framework of the fan box, and mounting the formed fan box on the fan module brackets.

Upon the forming, the framework of the fan box may be formed by inserting three connection ends of the box frame connector, located at a corner of the fan box to protrude substantially perpendicular to one another, into hollow ends of the box frames forming the corner of the fan box and securing the connection ends to the box frames. Upon the forming, the safety nets may be secured to extensions of the box frames that extend substantially parallel to surfaces of the fan box.

The installing of the centrifugal fan may include installing a pair of motor brackets in the fan box, installing a support plate such that both ends of the support plate are supported by the motor brackets, coupling the fan motor to the installed support plate, and installing the centrifugal fan such that the coupled fan motor is linearly coaxial with a rotational center of the centrifugal fan. The connecting may include installing a fan shield having a hole to form a surface of the fan box facing the suction chamber, communicating the centrifugal fan with the outside of the fan box using an air guide after the fan shield is installed, one or a first end of the air guide being coupled to and in communication with the hole, and the other or a second end of the air guide extending to a fan shroud that protrudes from the centrifugal fan toward the suction chamber and forming an air flow path by shielding a space between a communication opening formed in the separation partition and the fan shield from the outside.

An air handler and an assembly method thereof according to embodiments has been described in detail with reference to the accompanying drawings. However, embodiments should not be limited by the above-described exemplary embodiments, and various modifications and equivalent implementations may be made by those skilled in the art. Hence, the scope should be defined by the accompanying claims.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air handler, comprising:

an air suction module configured to suction in indoor air;

a mixing module configured to be coupled to and in communication with the air suction module to mix the indoor air supplied from the air suction module with outside air suctioned in from an outside;

a heat exchange module configured to be coupled to and in communication with the mixing module to heat exchange with the mixed air supplied from the mixing module; and an air discharge module configured to be coupled to and in communication with the heat exchange module to discharge the heat exchanged air supplied from the heat exchange module to a room, wherein the air suction module comprises:

a lower cover in the form of a combination of a plurality of module frames and a plurality of case panels, wherein the lower cover forms a lower surface of the air suction module;

a first side cover and a second side cover in the form of a combination of the plurality of module frames and the plurality of case panels, wherein the first side cover forms a first side surface of the air suction module and the second side cover forms a second side surface of the air suction module;

an upper cover in the form of a combination of the plurality of module frames and the plurality of case panels, wherein the upper cover forms an upper surface of the air suction module; and a separation partition to divide an inner space of the air suction module into a suction chamber to introduce air at a first side thereof, and a centrifugal chamber at a second side thereof, wherein the centrifugal chamber accommodates a fan module configured to generate an airflow, wherein the separation partition includes a communication opening that provides communication between the suction chamber and the centrifugal chamber, wherein each of the first side cover and the second side cover includes two side case panels and a middle vertical frame between the two side case panels, and wherein both lateral ends of the separation partition are slidably inserted in a vertical direction into the middle vertical frame of the first side cover and the middle vertical frame of the second side cover.

2. The air handler according to claim 1, further comprising a base disposed below the air suction module to support a weight of the air suction module.

3. The air handler according to claim 2, wherein the base is coupled to the lower cover.

4. The air handler according to claim 1, wherein a lower end of the separation partition is slidably coupled to the lower cover, and an upper end of the separation partition is slidably coupled to the upper cover.

5. The air handler according to claim 4, wherein a lower middle frame of the plurality of module frames bisects the lower cover of the air suction module, the middle frame being horizontally arranged between two lower case panels, and wherein the lower end of the separation partition is slidably coupled to the lower middle frame.

6. The air handler according to claim 4, wherein an upper middle frame of the plurality of module frames bisects the upper cover of the air suction module, the upper middle frame being horizontally arranged between two upper case panels of the upper cover, and wherein the upper end of the separation partition is slidably coupled to the upper middle frame.

7. The air handler according to claim 6, wherein the upper cover is selectively slidably coupled to the plurality of module frames to form a suction opening, through which air is suctioned in from the outside to the inner space of the air suction module through the plurality of module frames, or to form a discharge opening, through which air is discharged from the inner space of the air suction module to the outside.

8. The air handler according to claim 1, wherein the fan module is accommodated in the centrifugal chamber and suctions in air from the suction chamber to the centrifugal chamber through the communication opening of the separation partition and then discharges the air to the outside or another module located at a side thereof.

9. The air handler according to claim 8, wherein the fan module includes at least one fan box, wherein each of the at least one fan box accommodates a centrifugal fan therein and comprises:

a plurality of box frames that forms a framework of the respective fan box;

at least one box frame connector that connects at least two of the plurality of box frames at a corner of the respective fan box; and a plurality of safety nets coupled to the framework of the at least one fan box formed by the plurality of box frames to form surfaces of the respective fan box, and wherein each of the at least one fan box is coupled to and in communication with the communication opening of the separation partition.

10. The air handler according to claim 9, wherein each of the at least one fan box is coupled to the communication opening of the separation partition to allow interior air of the suction chamber to pass through the centrifugal fan accommodated in the respective fan box in the centrifugal chamber.

11. The air handler according to claim 10, wherein the plurality of safety nets is coupled to the plurality of box frames to form a rectangular parallelepiped having an open side that faces the suction chamber, wherein the open side is coupled to a fan shield having a hole, and wherein the fan shield is coupled to the communication opening of the separation partition to shield a space therebetween from the outside.

12. The air handler according to claim 10, wherein the plurality of safety nets is coupled to the plurality of box frames to form a rectangular parallelepiped having an open side that faces the suction chamber, wherein the open side is coupled to a fan shield having a hole, wherein the fan shield and the centrifugal fan are arranged with an air guide interposed therebetween, wherein a first end of the air guide is coupled to the hole and a second end of the air guide extends to a fan shroud of the centrifugal fan, and wherein the air guide guides air suctioned from the suction chamber to move into the centrifugal fan.

13. The air handler according to claim 9, wherein each of the plurality of box frames includes hollow ends having a triangular cross section and an extension that extends substantially in parallel to each surface of the respective fan box, wherein the at least one box frame connector has a portion inserted into each hollow end of the respective box frame at a corner of the respective fan box, and wherein each of the plurality of safety nets is coupled to the extension.

14. The air handler according to claim 9, wherein the centrifugal fan comprises:

a pair of main plates spaced apart from each other in a direction of a rotational axis of the centrifugal fan, wherein the main plates are vertically oriented; and a plurality of blades spaced apart from one another in a circumferential direction between the main plates to connect the pair of main plates to each other, wherein, upon rotation of the centrifugal fan, air in the suction chamber is suctioned into a space between the pair of main plates in the direction of the rotational axis of the centrifugal fan and then discharged in a circumferential direction to the centrifugal chamber by the plurality of blades.

15. The air handler according to claim 14, wherein each of the at least one fan box further includes a fan motor that applies torque to the centrifugal fan, and wherein the fan motor is linearly coaxial with the rotational axis of the centrifugal fan.

16. The air handler according to claim 1, wherein the air suction module comprises a plurality of air suction modules.

17. An air handler, comprising:

a plurality of modules, each module comprising:

a lower cover in the form of a combination of a plurality of module frames and a plurality of case panels that form a framework and surfaces of the respective module, wherein the lower cover forms a lower surface of the respective module;

a plurality of side covers in the form of a combination of the plurality of module frames and the plurality of case panels, wherein the plurality of side covers forms a plurality of side surfaces of the respective module, and wherein at least one of the plurality of side covers comprises two side case panels and a middle vertical frame between the two side case panels; and an upper cover in the form of a combination of the plurality of module frames and the plurality of case panels, wherein the upper cover forms an upper surface of the respective module, wherein one or more of the plurality of modules further comprises a separation partition to divide an inner space of the respective module into a plurality of chambers, and wherein at least one lateral end of the separation partition is slidably inserted in a substantially, vertical direction into the middle vertical frame.

18. The air handler according to claim 17, wherein the plurality of modules comprises an air suction module, a mixing module, a heat exchange module, and an air discharge module.

19. The air handler according to claim 18, wherein only the air suction module and the air discharge module each comprises the separation partition and a fan module.

* * * * *